US005543257A

United States Patent [19]

Suzuki et al.

[11] Patent Number: 5,543,257

[45] Date of Patent: Aug. 6, 1996

[54] ELECTROPHOTOGRAPHIC PHOTOSENSITIVE MEMBER, PROCESS CARTRIDGE INCLUDING SAME AND ELECTROPHOTOGRAPHIC APPARATUS

[75] Inventors: Koichi Suzuki; Hideyuki Takai; Hajime Miyazaki, all of Yokohama; Satomi Sugiyama; Mitsuhiro Kunieda, both of Kawasaki, all of Japan

[73] Assignee: Canon Kabushiki Kaisha, Tokyo, Japan

[21] Appl. No.: 345,707

[22] Filed: Nov. 22, 1994

[30] Foreign Application Priority Data

Nov. 22, 1993 [JP] Japan ..... 5-314055

[51] Int. Cl.[6] ..... G03G 5/06

[52] U.S. Cl. ..... 430/58; 430/75; 355/271

[58] Field of Search ..... 430/58, 59, 75; 355/271

[56] References Cited

U.S. PATENT DOCUMENTS

| | | | |
|---|---|---|---|
| 4,917,981 | 4/1990 | Nakamura et al. | 430/75 |
| 5,312,707 | 5/1994 | Ota et al. | 430/59 |

FOREIGN PATENT DOCUMENTS

| | | |
|---|---|---|
| 61-215556 | 9/1986 | Japan . |
| 63-177143 | 7/1988 | Japan . |
| 63-178247 | 7/1988 | Japan . |
| 63-183449 | 7/1988 | Japan . |
| 2-84659 | 3/1990 | Japan . |

OTHER PUBLICATIONS

Database WPI, Week 9316, Derwent AN 93–129566 based on JPA 5–066591.

Database WPI, Week 9217, Derwent, AN 92–138541 based on JPA 4–081859.

*Primary Examiner*—John Goodrow

*Attorney, Agent, or Firm*—Fitzpatrick, Cella, Harper & Scinto

[57] ABSTRACT

An electrophotographic photosensitive member is constituted by an electroconductive support and a photosensitive layer disposed on the electroconductive support. The photosensitive layer contains a specific disazo pigment having a 2,2'-bis-1,3-benzdithiolene-diyl skeleton or a thiophene-diyl skeleton. The photosensitive member is effective for providing a process cartridge and an electrophotographic apparatus respectively including the photosensitive member with an excellent photosensitivity and a stable electric potential in repetitive use.

23 Claims, 1 Drawing Sheet

ELECTROPHOTOGRAPHIC PHOTOSENSITIVE MEMBER, PROCESS CARTRIDGE INCLUDING SAME AND ELECTROPHOTOGRAPHIC APPARATUS

FIELD OF THE INVENTION AND RELATED ART

The present invention relates to an electrophotographic photosensitive member, particularly to an electrophotographic photosensitive member having a photosensitive layer containing a specific disazo pigment.

The present invention also relates to a process cartridge and an electrophotographic apparatus respectively using the electrophotographic photosensitive member.

Hitherto, there have been proposed organic photoconductive materials to be used for electrophotographic photosensitive members.

The photosensitive members employing the organic photoconductive materials have advantages in that the photosensitive members may easily be produced, are relatively inexpensive and readily control a wavelength region having sensitivity (or photosensitivity) by appropriately selecting dyes or pigments used. Thus, many photosensitive members employing organic photoconductive materials have heretofore been proposed. Particularly, there has been proposed a photosensitive member having a lamination-type structure, wherein a photosensitive layer comprises a charge generation layer containing a charge-generating material such as organic photoconductive dyes or pigments and a charge-transport layer containing a charge-transporting material such as photoconductive polymers or low-molecular weight organic photoconductive materials (i.e., so-called "function-separation type photosensitive member"). Such a function-separation type photosensitive member has brought about a considerable improvement on a conventional organic photosensitive member having defects such as low sensitivity and poor durability.

As the organic photoconductive materials, a large number of azo pigments have been proposed since the azo pigments have excellent photoconductivity and are relatively readily produced by appropriately selecting an azo component and a coupler component in providing various electrophotographic characteristics. Such azo pigments have been disclosed in Japanese Laid-Open Patent Application Nos. (JP-A) 61-215556 (corresponding to U.S. Pat. No. 4,666,805) 63-177143 (U.S. Pat. No. 4,917,981), 63-178247 (U.S. Pat. No. 4,917,981), 63-183449, 2-84659, etc.

In recent years, however, a further improvement in electrophotographic characteristics such as the resultant image qualities and durability is required. Accordingly, with respect to the above-mentioned photosensitive member, there is still room for improvement in sensitivity and stability of electric potential in repetitive use, etc.

SUMMARY OF THE INVENTION

An object of the present invention is to provide an electrophotographic photosensitive member having high photosensitivity.

Another object of the present invention is to provide an electrophotographic photosensitive member which has excellent stability of electric potential in repetitive use.

A further object of the present invention is to provide a process cartridge and an electrophotographic apparatus respectively including the electrophotographic photosensitive member as described above.

According to the present invention, there is provided an electrophotographic photosensitive member, comprising: an electroconductive support and a photosensitive layer disposed on the electroconductive support, wherein the photosensitive layer comprises a disazo pigment represented by the formula (1) below or a disazo pigment represented by the formula (2) below:

Formula (1):

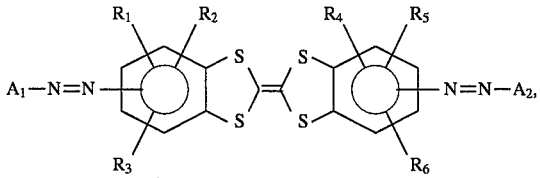

(1)

wherein $R_1$ to $R_6$ independently denote hydrogen atom, halogen atom, alkyl group, alkoxy group or aryl group; and $A_1$ and $A_2$ independently denote a coupler residue having phenolic hydroxyl group, or Formula (2):

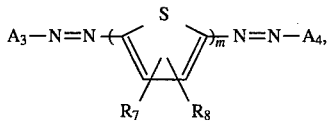

(2)

wherein $R_7$ and $R_8$ independently denote hydrogen atom, halogen atom, alkyl group, alkoxy group or aryl group; $A_3$ and $A_4$ independently denote a coupler residue having phenolic hydroxyl group, and at least one of $A_3$ and $A_4$ is represented by the following formula (3):

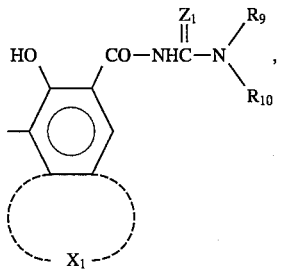

(3)

wherein $X_1$ denotes a residual group for forming polycyclic aromatic ring or polycyclic heterocycle by condensation reaction with benzene ring; $R_9$ and $R_{10}$ independently denote hydrogen atom, alkyl group, aryl group, aralkyl group or heterocyclic group, and $R_9$ and $R_{10}$ can be connected with each other to form cyclic amino group; $Z_1$ denotes oxygen atom or sulfur atom; and m is a positive integer.

According to the present invention, there is also provided a process cartridge and an electrophotographic apparatus respectively including the above-mentioned electrophotographic photosensitive member.

These and other objects, features and advantages of the present invention will become more apparent upon a consideration of the following description of the preferred embodiments of the present invention taken in conjunction with the accompanying drawings.

DETAILED DESCRIPTION OF THE INVENTION

Figure 1:
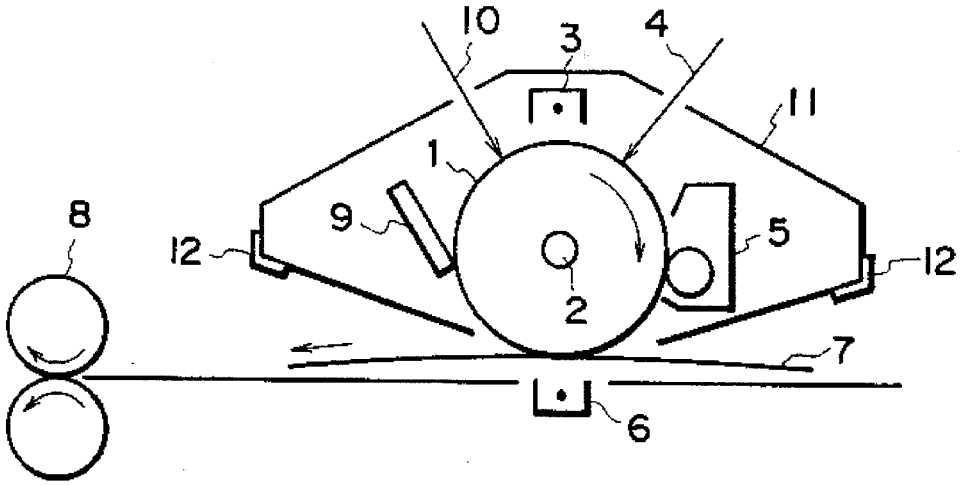
FIG. 1 is a schematic structural view of an electrophotographic apparatus including a process cartridge using an electrophotographic photosensitive member according to the present invention.

The electrophotographic photosensitive member according to the present invention is characterized by a photosensitive layer comprising a disazo pigment of the formula (1) or a disazo pigment of the formula (2) (including the formula (3)) each having a coupler residue.

Herein, the term "coupler residue" as $A_1$ to $A_4$ in the formula (1) and (2) means a group derived from a corresponding coupler (coupling component) by dropping any one hydrogen atom from a benzene ring constituting the coupler component. In the present invention, such a hydrogen atom may preferably be in the ortho position in respect to phenolic hydroxyl group.

In case where the photosensitive layer comprises a disazo pigment of the formula (1), specific examples of $R_1$ to $R_6$ may include: hydrogen atom; halogen atom such as fluorine atom, chlorine atom or iodine atom; alkyl group such as methyl, ethyl or propyl; alkoxy group such as methoxy, ethoxy or propoxy; and aryl group such as phenyl, naphthyl or anthryl. Among these specific examples, $R_1$ to $R_6$ may preferably be hydrogen atom simultaneously.

In the formula (1), $A_1$ and $A_2$ each may preferably be a coupler residue represented by any one of the following formulae (4)–(9):

Formula (4):

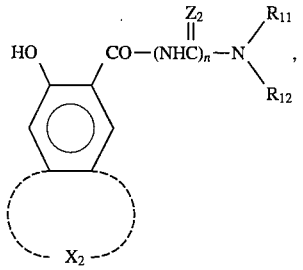

(4)

wherein $X_2$ denotes a residual group for forming polycyclic aromatic ring or polycyclic heterocycle by condensation reaction with benzene ring; $R_{11}$ and $R_{12}$ independently denote hydrogen atom, alkyl group, aryl group, aralkyl group or heterocyclic group, and $R_{11}$ and $R_{12}$ can be connected with each other to form cyclic amino group; $Z_2$ denotes oxygen atom or sulfur atom; and n is 0 or 1;

Example (5):

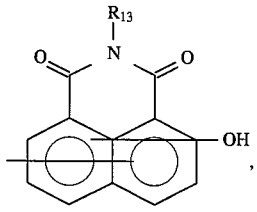

(5)

wherein $R_{13}$ denotes alkyl group, aryl group, aralkyl group or heterocyclic group;

Formula (6):

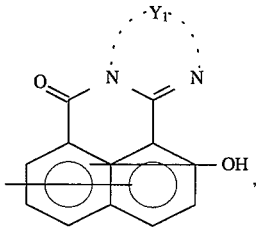

(6)

wherein $Y_1$ denotes arylene group or divalent heterocyclic group;

Formula (7):

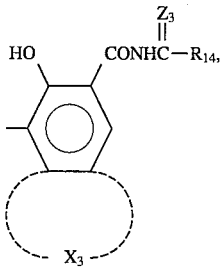

(7)

wherein $X_3$ denotes a residual group for forming polycyclic aromatic ring or polycyclic heterocycle by condensation reaction with benzene ring; $R_{14}$ denotes hydrogen atom, alkyl group, aryl group, aralkyl group or heterocyclic group; and; $Z_3$ denotes oxygen atom or sulfur atom;

Formula (8):

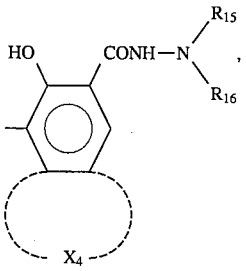

(8)

wherein $X_4$ denotes a residual group for forming polycyclic aromatic ring or polycyclic heterocycle by condensation reaction with benzene ring; and $R_{15}$ and $R_{16}$ independently denote hydrogen atom, alkyl group, aryl group, aralkyl group or heterocyclic group, and $R_{15}$ and $R_{16}$ can be connected with each other to form cyclic amino group; and Formula (9):

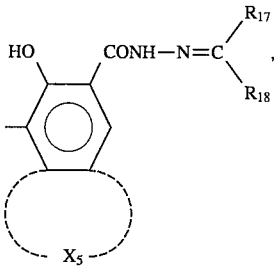

(9)

wherein $X_5$ denotes a residual group for forming polycyclic aromatic ring or polycyclic heterocycle by condensation reaction with benzene ring; and $R_{17}$ and $R_{18}$ independently denote hydrogen atom, alkyl group, aryl group, aralkyl group or heterocyclic group, and $R_{17}$ and $R_{18}$ can be connected with each other to form cyclic group.

In the above formulae (4), (7), (8) and (9), specific examples of polycyclic aromatic ring formed through condensation reaction of benzene ring and each of $X_2$ to $X_5$ may include naphthalene ring and anthracene ring. Further, specific examples of polycyclic heterocycle may include carbazole ring, benzocarbazole ring and dibenzocarbazole ring.

In the above formula (6), specific examples of $Y_1$ may include o-phenylene, o-naphthylene, perinaphthylene, 1,2-anthrylene, 3,4-pyrazolediyl, 2,3-pyridinediyl, 4,5-pyridinediyl, 6,7-indazolediyl and 6,7-quinolinediyl.

In the above formulae (4), (5) and (7)–(9), specific examples of alkyl group for $R_{11}$–$R_{18}$, aryl group for $R_{11}$–$R_{18}$, aralkyl group for $R_{11}$–$R_{18}$, heterocyclic group for $R_{11}$–$R_{18}$ and cyclic amino group for $R_{11}$ and $R_{12}$ or $R_{15}$ and $R_{16}$ may include those below:

alkyl group: methyl, ethyl and propyl;

aryl group: phenyl, naphthyl and anthryl;

aralkyl group: benzyl and phenethyl;

heterocyclic group: pyridyl, thienyl, thiazolyl, carbazolyl, benzimidazolyl, and benzothiazolyl; and cyclic amino group: pyrrolyl, indolyl, indolinyl, carbazolyl, imidazolyl, benzimidazolyl, pyrazolyl, phenothiazinyl and phenoxazinyl.

In the formula (9), specific examples of cyclic group formed by connecting $R_{17}$ with $R_{18}$ may include fluorenylidene, xanthenylidene, anthronylidene and hydroindenylidene.

In the formulae (4)–(9), each of $X_2$ to $X_5$, $Y_1$, and $R_{11}$ to $R_{18}$ may have a substituent. Examples of such a substituent may include: alkyl group such as methyl, ethyl or propyl; alkoxy group such as methoxy, ethoxy or propoxy; halogen atom such as fluorine, chlorine, bromine or iodine; acyl group such as acetyl or benzoyl; alkylamino group such as dimethylamino or diethylamino; phenylcarbamoyl group; nitro group; cyano group; and haloalkyl group such as trifluoromethyl.

In the formula (1), $A_1$ and $A_2$ each may preferably be selected from the group consisting of coupler residues represented by the formulae (4), (7), (8) and (9) in which $X_2$ to $X_5$ each are a residual group for forming benzocarbazole ring by condensation reaction with benzene ring. By using a diazo pigment of the formula (1) including such $A_1$ and $A_2$, it is possible to enlarge or expand a photosensitive region to a region close to near infrared region. As a result, the disazo pigment of the formula (1) may preferably be used as a charge-generating material for use in a semiconductor laser.

The disazo pigment of the formula (1) may preferably have the following formula:

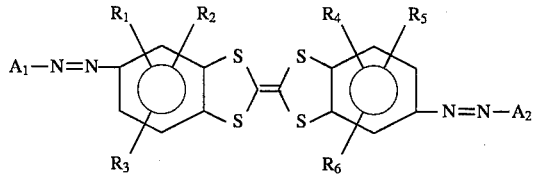

or

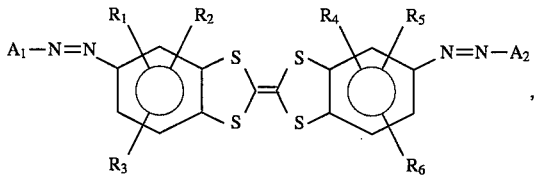

particularly,

-continued

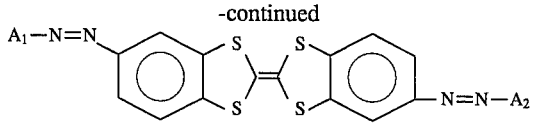

or

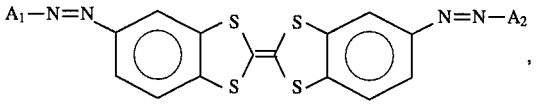

wherein $A_1$, $A_2$ and $R_1$ to $R_6$ have the same meanings as described above.

In case where the photosensitive layer comprises a disazo pigment of the formula (2), specific examples of $R_7$ and $R_8$ may include: hydrogen atom; halogen atom such as fluorine atom, chlorine atom or iodine atom; alkyl group such as methyl, ethyl or propyl; alkoxy group such as methoxy, ethoxy or propoxy; and aryl group such as phenyl, naphthyl or anthryl. Among these specific examples, $R_7$ to $R_8$ may preferably be hydrogen atom simultaneously.

In the formula (2), m may preferably be an integer of 2–7. In case where m is 2 or above, the disazo pigment of the formula (2) may preferably have a 2,5-thiophene-diyl skeleton (i.e., two or more thiophene rings connected with each other at 2,5-positions). Such a 2,5-thiophene-diyl skeleton may have at least two $R_7$ groups being the same or different and at least two $R_8$ groups being the same or different.

In the above formula (3), specific examples of polycyclic aromatic ring formed through condensation reaction of benzene ring and $X_1$ may include naphthalene ring and anthracene ring. Further, specific examples of polycyclic heterocycle may include carbazole ring, benzocarbazole ring and dibenzocarbazole ring.

In the above formula (3), specific examples of alkyl group, aryl group, aralkyl group, heterocyclic group and cyclic amino group each for $R_9$ and $R_{10}$ may include those below:

alkyl group: methyl, ethyl and propyl;

aryl group: phenyl, naphthyl and anthryl;

aralkyl group: benzyl and phenethyl;

heterocyclic group: pyridyl, thienyl, thiazolyl, carbazolyl, benzimidazolyl, and benzothiazolyl; and cyclic amino group: pyrrolyl, indolyl, indolinyl, carbazolyl, imidazolyl, benzimidazolyl, pyrazolyl, phenothiazinyl and phenoxazinyl.

In the formulae (3) and (4), each of $R_7$ to $R_{10}$ and $X_1$ may have a substituent. Examples of such a substituent may include: alkyl group such as methyl, ethyl or propyl; alkoxy group such as methoxy, ethoxy or propoxy; halogen atom such as fluorine, chlorine, bromine or iodine; acyl group such as acetyl or benzoyl; alkylamino group such as dimethylamino or diethylamino; phenylcarbamoyl group; nitro group; cyano group; and haloalkyl group such as trifluoromethyl.

In the present invention, both of $A_3$ and $A_4$ in the formula (2) may preferably be a coupler residue of the formula (3). In case where one of $A_3$ and $A_4$ is a coupler residue of the formula (3), the other $A_1$ or $A_2$ may preferably be selected from the group consisting of coupler residues represented by the formulae (10) to (15) below:

Formula (10):

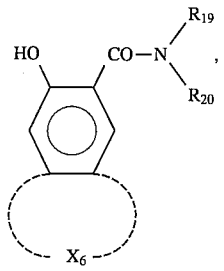

(10)

wherein $X_6$ denotes a residual group for forming polycyclic aromatic ring or polycyclic heterocycle by condensation reaction with benzene ring; and $R_{19}$ and $R_{20}$ independently denote hydrogen atom, alkyl group, aryl group, aralkyl group or heterocyclic group, and $R_{19}$ and $R_{20}$ can be connected with each other to form cyclic amino group;

Example (11):

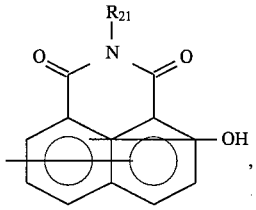

(11)

wherein $R_{13}$ denotes alkyl group, aryl group, aralkyl group or heterocyclic group;

Formula (12):

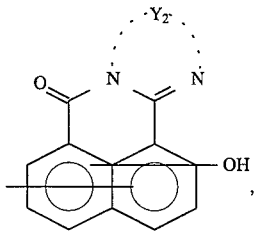

(12)

wherein $Y_1$ denotes arylene group or divalent heterocyclic group;

Formula (13):

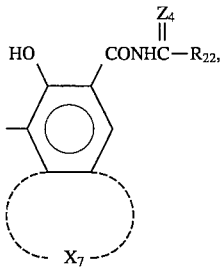

(13)

wherein $X_7$ denotes a residual group for forming polycyclic aromatic ring or polycyclic heterocycle by condensation reaction with benzene ring; $R_{22}$ denotes hydrogen atom, alkyl group, aryl group, aralkyl group or heterocyclic group; and; $Z_4$ denotes oxygen atom or sulfur atom;

Formula (14):

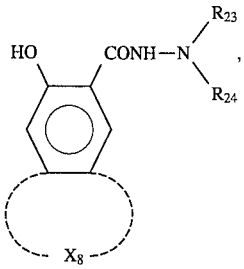

(14)

wherein $X_8$ denotes a residual group for forming polycyclic aromatic ring or polycyclic heterocycle by condensation reaction with benzene ring; and $R_{23}$ and $R_{24}$ independently denote hydrogen atom, alkyl group, aryl group, aralkyl group or heterocyclic group, and $R_{23}$ and $R_{24}$ can be connected with each other to form cyclic amino group; and Formula (15):

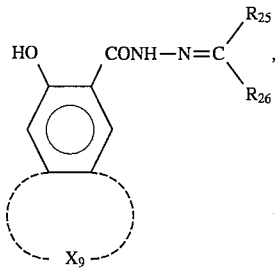

(15)

wherein $X_9$ denotes a residual group for forming polycyclic aromatic ring or polycyclic heterocycle by condensation reaction with benzene ring; and $R_{25}$ and $R_{26}$ independently denote hydrogen atom, alkyl group, aryl group, aralkyl group or heterocyclic group, and $R_{25}$ and $R_{26}$ can be connected with each other to form cyclic group.

In the above formulae (10), (13), (14) and (15), specific examples of polycyclic aromatic ring formed through condensation reaction of benzene ring and each of $X_6$ to $X_9$ may include naphthalene ring and anthracene ring. Further, specific examples of polycyclic heterocycle may include carbazole ring, benzocarbazole ring and dibenzocarbazole ring.

In the above formula (12), specific examples of $Y_2$ may include o-phenylene, o-naphthylene, perinaphthylene, 1,2-anthrylene, 3,4-pyrazolediyl, 2,3-pyridinediyl, 4,5-pyridinediyl, 6,7-indazolediyl and 6,7-quinolinediyl.

In the above formulae (10), (11) and (13)–(15), specific examples of alkyl group for $R_{19}$–$R_{26}$, aryl group for $R_{19}$–$R_{26}$, aralkyl group for $R_{19}$–$R_{26}$, heterocyclic group for $R_{19}$–$R_{26}$ and cyclic amino group for $R_{19}$ and $R_{20}$ or $R_{23}$ and $R_{24}$ may include those below:

alkyl group: methyl, ethyl and propyl;

aryl group: phenyl, naphthyl and anthryl;

aralkyl group: benzyl and phenethyl;

heterocyclic group: pyridyl, thienyl, thiazolyl, carbazolyl, benzimidazolyl, and benzothiazolyl; and cyclic amino group: pyrrolyl, indolyl, indolinyl, carbazolyl, imidazolyl, benzimidazolyl, pyrazolyl, phenothiazinyl and phenoxazinyl.

In the formula (15), specific examples of cyclic group formed by connecting $R_{25}$ with $R_{26}$ may include fluorenylidene, xanthenylidene, anthronylidene and hydroindenylidene.

In the formulae (10)–(15), each of $X_6$ to $X_9$, $Y_2$, and $R_{19}$ to $R_{26}$ may have a substituent. Examples of such a substituent may include: alkyl group such as methyl, ethyl or propyl; alkoxy group such as methoxy, ethoxy or propoxy; halogen atom such as fluorine, chlorine, bromine or iodine; acyl group such as acetyl or benzoyl; alkylamino group such as dimethylamino or diethylamino; phenylcarbamoyl group; nitro group; cyano group; and haloalkyl group such as trifluoromethyl.

In the formula (2), $A_3$ and $A_4$ each may preferably be selected from the group consisting of coupler residues represented by the formulae (3), (10), (13), (14) and (15) in which $X_1$ and $X_6$ to $X_9$ each are a residual group for forming benzocarbazole ring by condensation reaction with benzene ring. By using a diazo pigment of the formula (2) including such $A_3$ and $A_4$, it is possible to enlarge or expand a photosensitive region to a region close to near infrared region. As a result, the disazo pigment of the formula (2) may preferably be used as a charge-generating material for use in a semiconductor laser.

The disazo pigment of the formula (2) may preferably have the following formula:

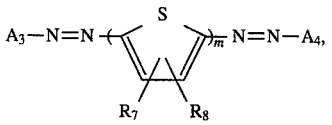

particularly,

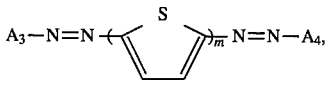

wherein m, $A_3$, $A_4$, $R_7$ and $R_8$ have the same meanings as described above. Further, in the above two formulae, m may more preferably be an integer of 2–7.

In the present invention, each of the coupler residues $A_1$ to $A_4$ in the formulae (1) and (2) may preferably have residual groups $X_1$ to $X_9$ for forming benzocarbazole ring through condensation reaction with benzene ring.

Hereinbelow, specific and non-exhaustive examples of the above-mentioned disazo pigments of the formulae (1) and (2) used in the present invention may include the following pigments classified into those represented by five fundamental structural formulae 1 to 5, to which the disazo pigments of the formulae (1) and (2) used in the present invention are however not restricted. In the following, each of specific examples 1-1 to 5-3 is represented by showing varying parts $A_1$, $A_2$, $R_A$, $R_B$, m, $A_3$, $A_4$, $R_C$, $R_D$ and p in the respective fundamental structural formulae 1 to 5.

Fundamental structural formula 1 (for the formula (1)):

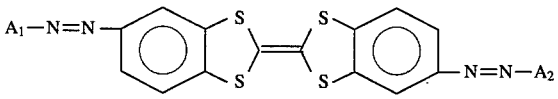

(Ex. Comp. No.)

1-1

$A_1$:

-continued

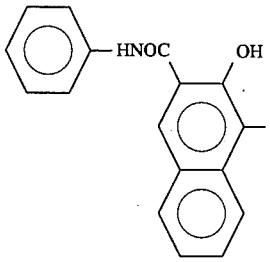

$A_2$:

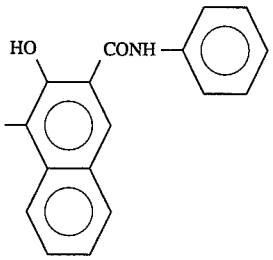

1-2

$A_1$:

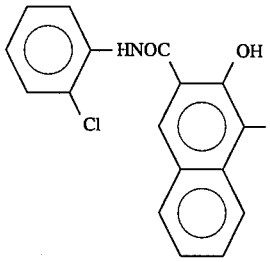

$A_2$:

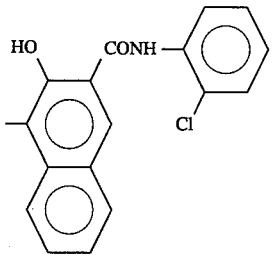

1-3

$A_1$:

-continued
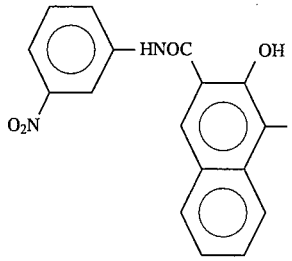
$A_2$:
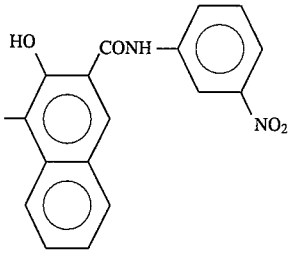
1-4
$A_1$:
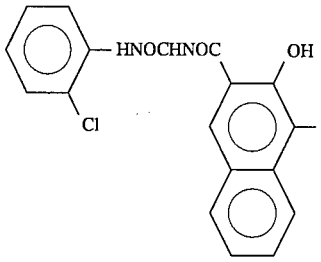
$A_2$:
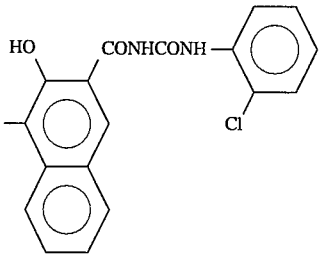
1-5
$A_1$:
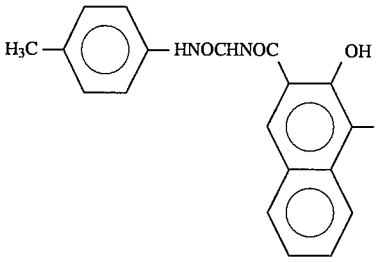
$A_2$:
-continued
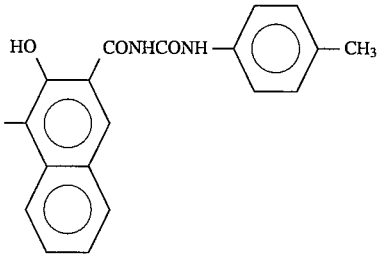
1-6
$A_1$:
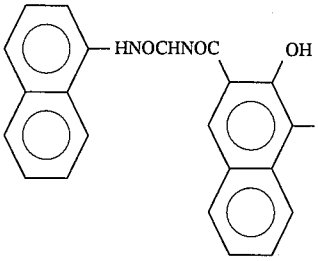
$A_2$:
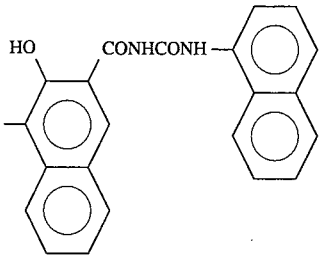
1-7
$A_1$:
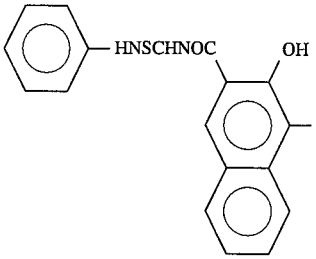
$A_2$:
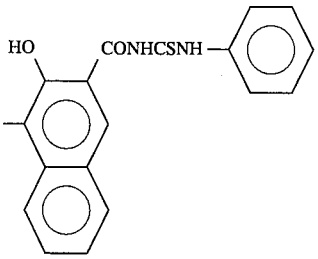
1-8
$A_1$:

-continued
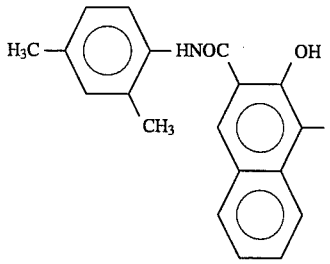
$A_2$:
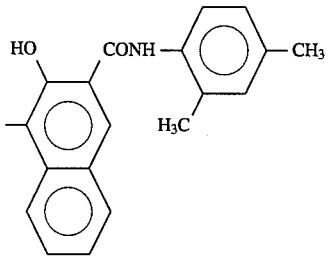
1-9
$A_1$:
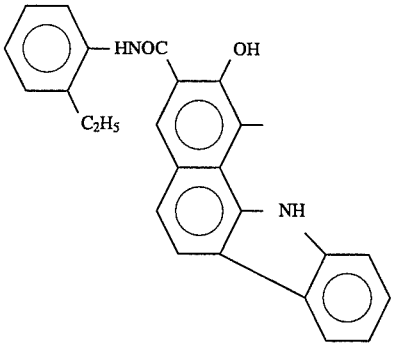
$A_2$:
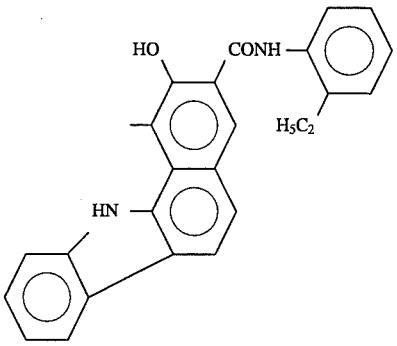
1-10
$A_1$:
-continued
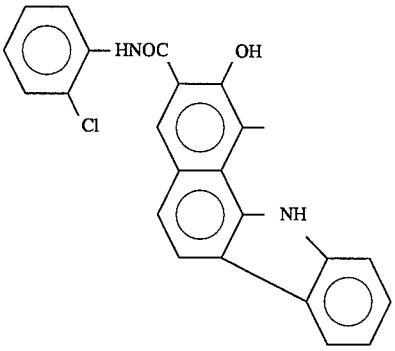
$A_2$:
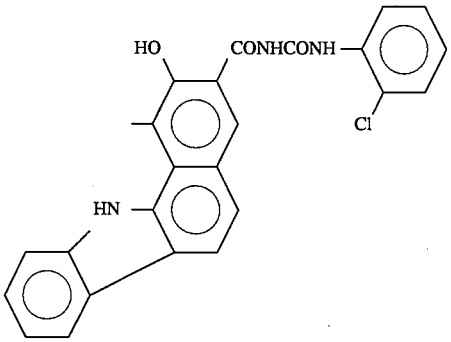
1-11
$A_1$:
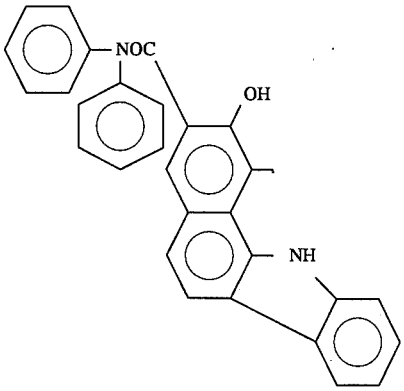
$A_2$:
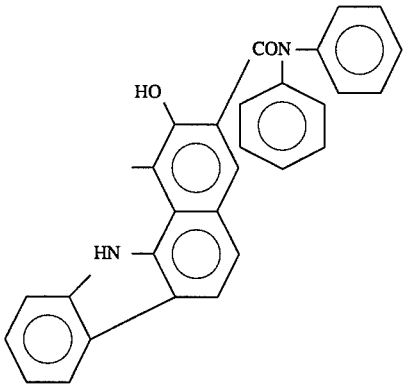
1-12

-continued
$A_1$:
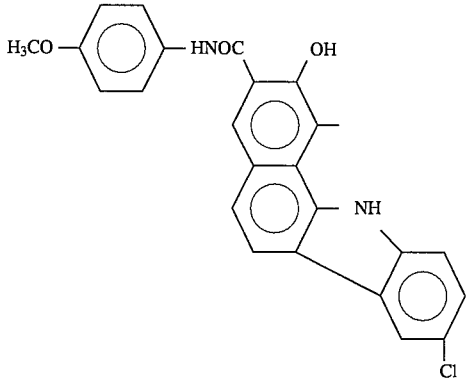
$A_2$:
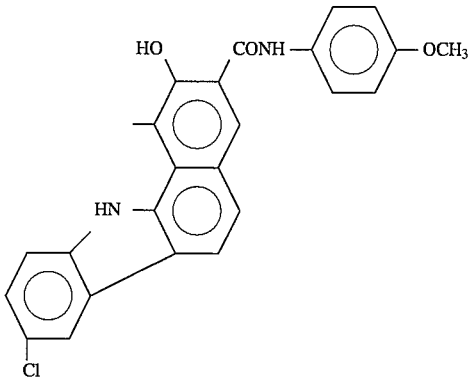
1-13
$A_1$:
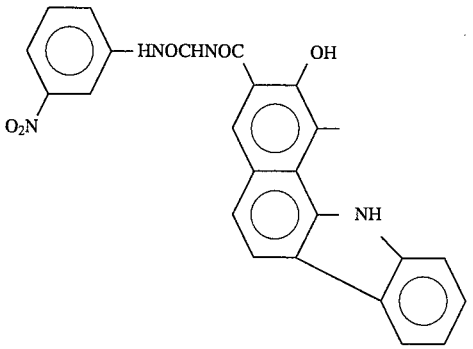
$A_2$:
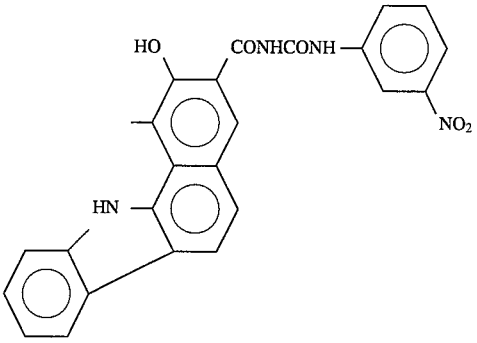
-continued
1-14
$A_1$:
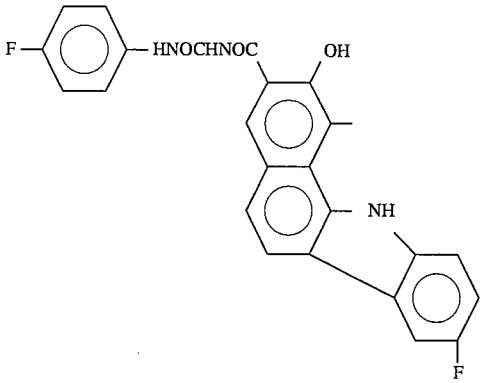
$A_2$:
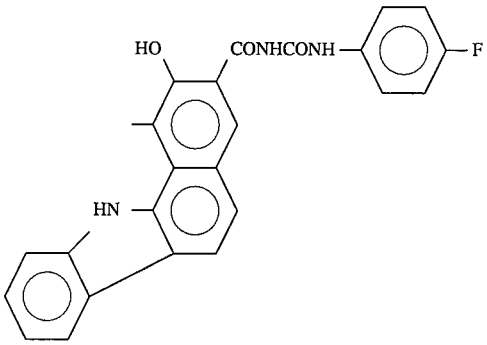
1-15
$A_1$:
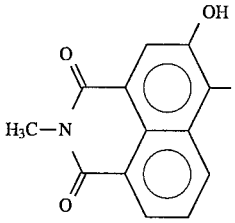
$A_2$:
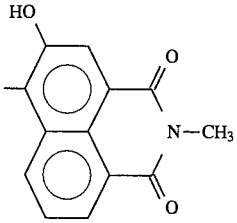
1-16
$A_1$:

-continued
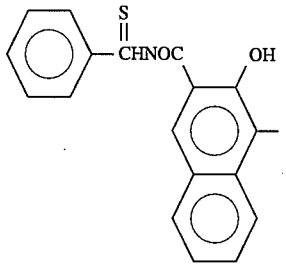
$A_2$:
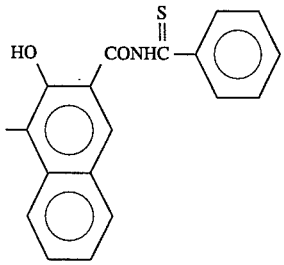
1-17
$A_1$:
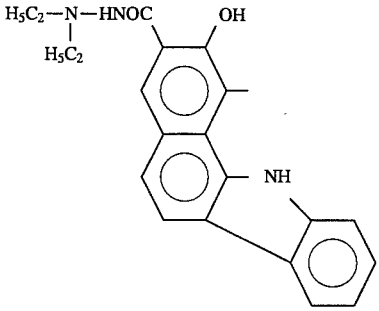
$A_2$:
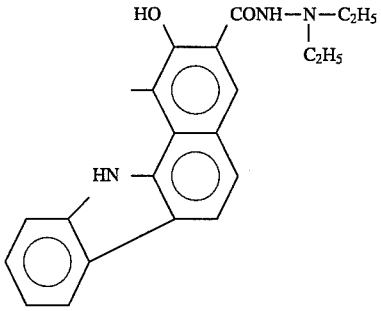
1-18
$A_1$:
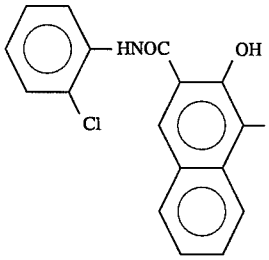
-continued
$A_2$:
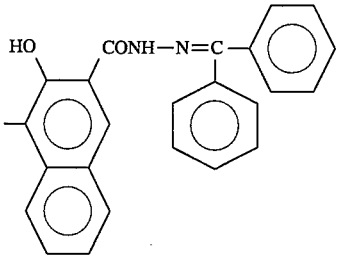
1-19
$A_1$:
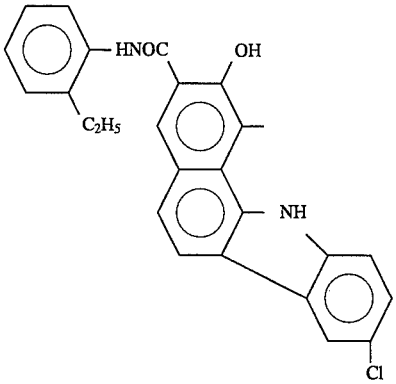
$A_2$:
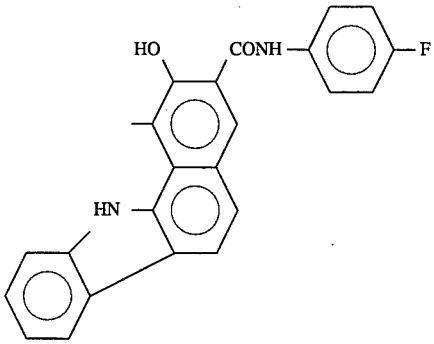
1-20
$A_1$:
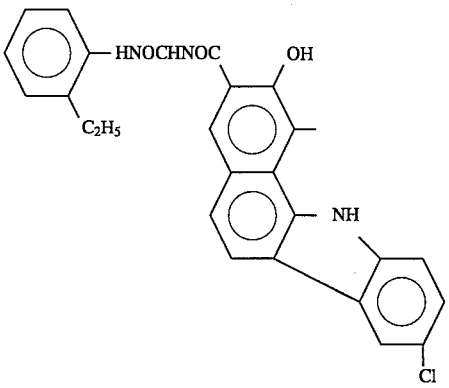
$A_2$:

-continued
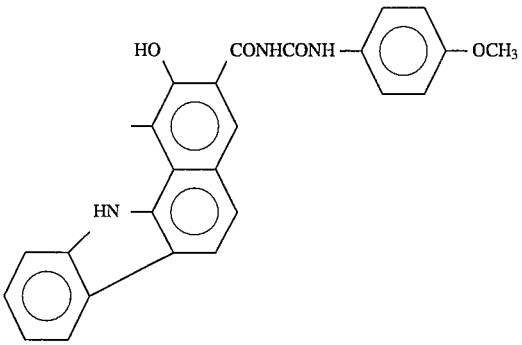
Fundamental structural formula 2 (for the formula (1)):
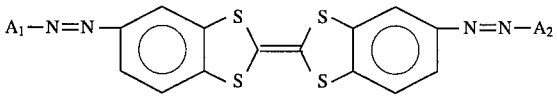
(Comp. Ex. No.)
2-1
$A_1$:
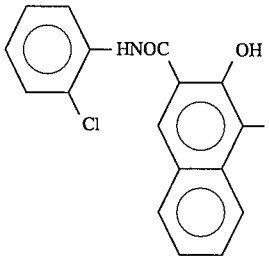
$A_2$:
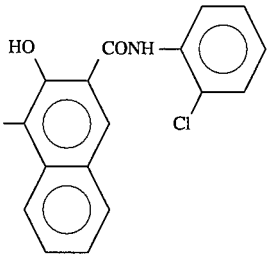
2-2
$A_1$:
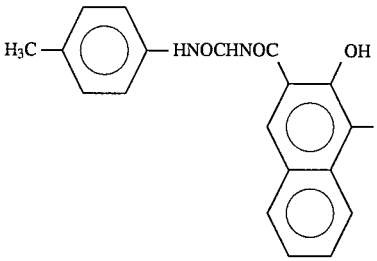
-continued
$A_2$:
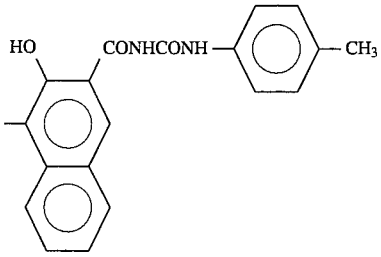
2-3
$A_1$:
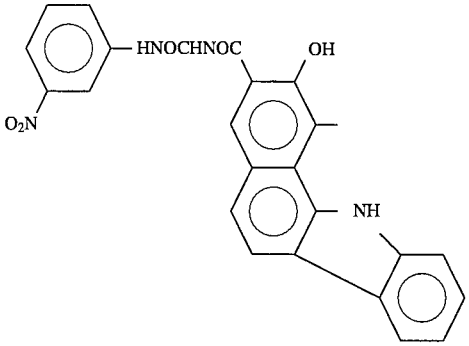
$A_2$:
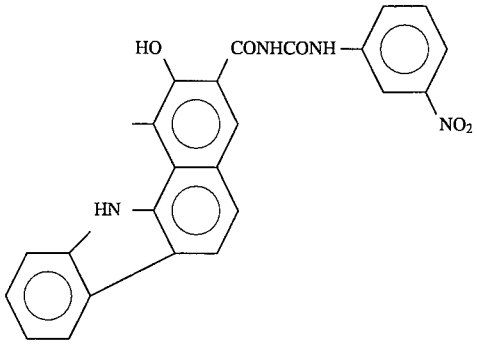
2-4
$A_1$:
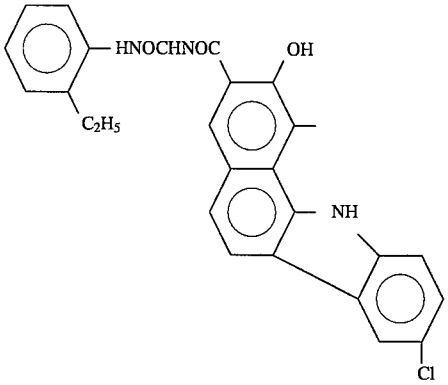
$A_2$:

-continued
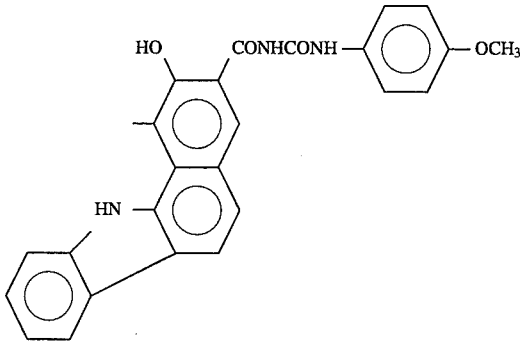
Fundamental structural formula 3 (for the formula (1)):
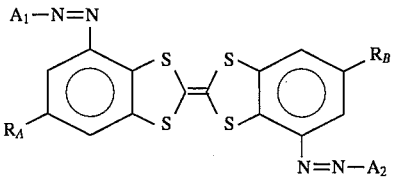
| (Ex. Comp. No.) | | |
|---|---|---|
| 3-1 | $R_A$: —H | $R_B$: —H |
| | A1: 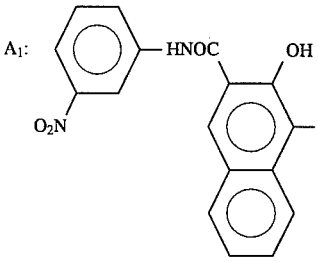 | A2: 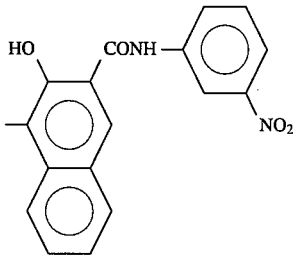 |
| 3-2 | $R_A$: —$CH_3$ | $R_B$: —$CH_3$ |
| | A1: 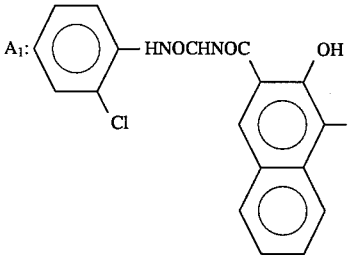 | A2: 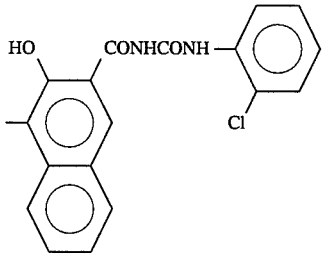 |
| 3-3 | $R_A$: — | $R_B$: — |

-continued
Fundamental structural formula 3 (for the formula (1)):
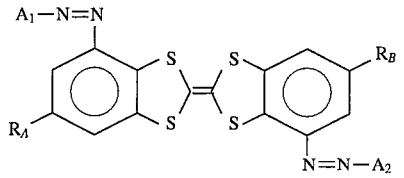
(Ex. Comp. No.)
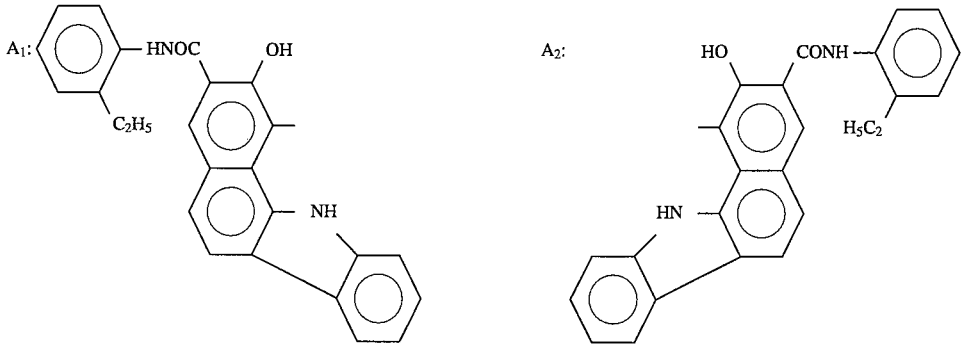
3-4 $R_A$: —Cl $R_B$: —$OCH_3$
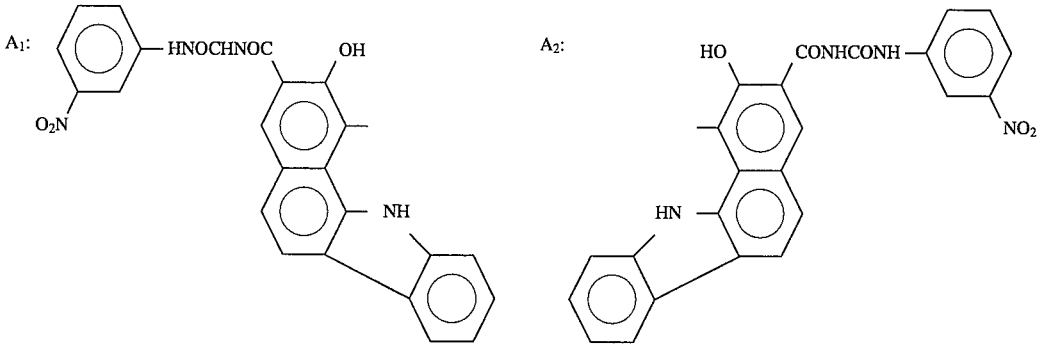
Fundamental structural formula 4 (for the formula (2)):
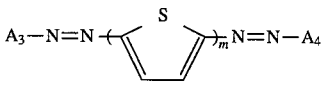
(Ex. Comp. No.)
4-1 m: 2
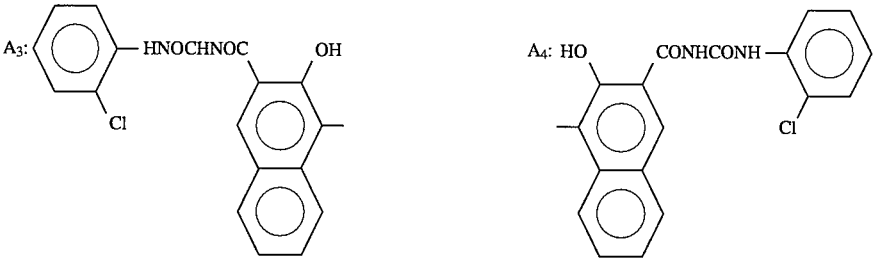

-continued
Fundamental structural formula 4 (for the formula (2)):
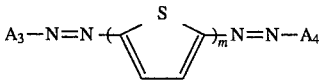
(Ex. Comp. No.)
4-2 m: 2
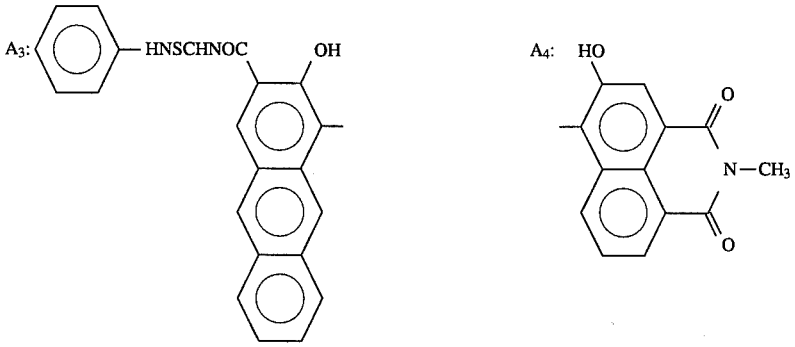
4-3 m: 2
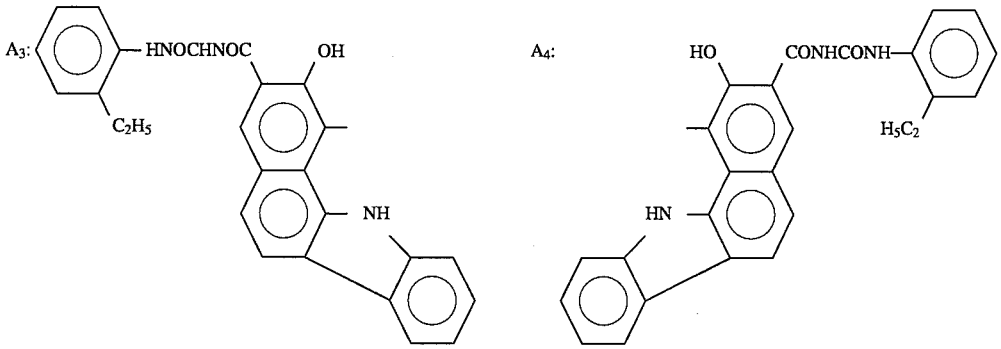
4-4 m: 2
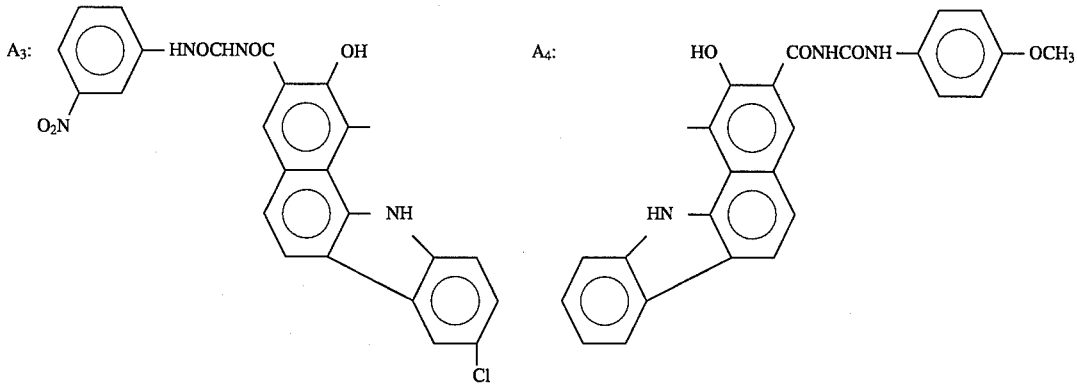
4-5 m: 2

-continued
Fundamental structural formula 4 (for the formula (2)):
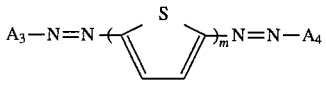
(Ex. Comp. No.)
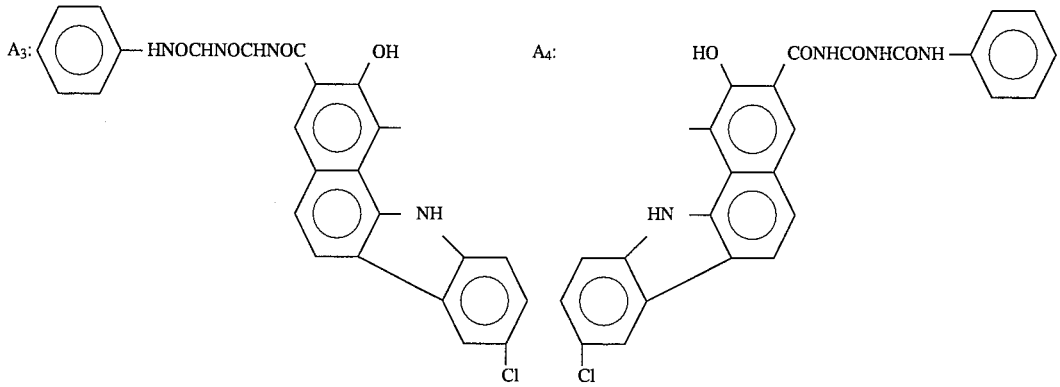
4-6 m: 3
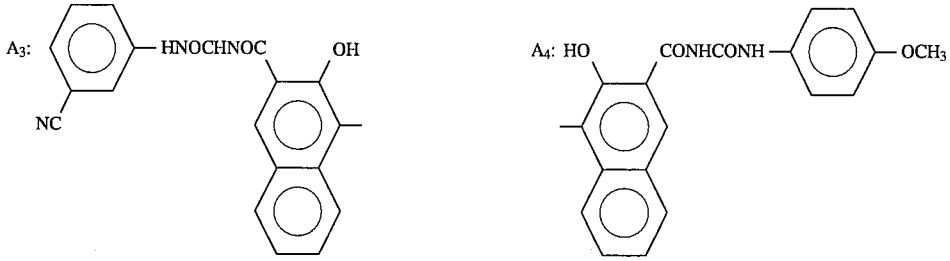
4-7 m: 3
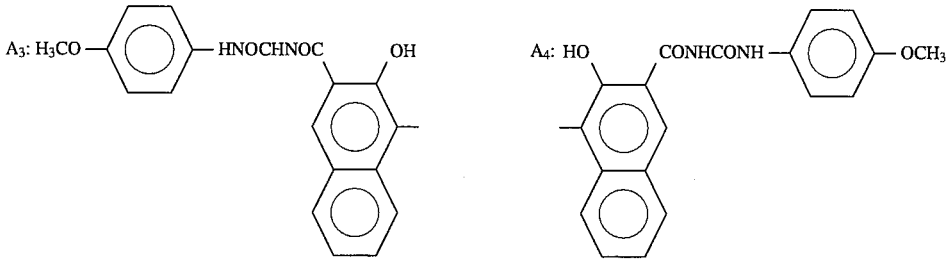
4-8 m: 3
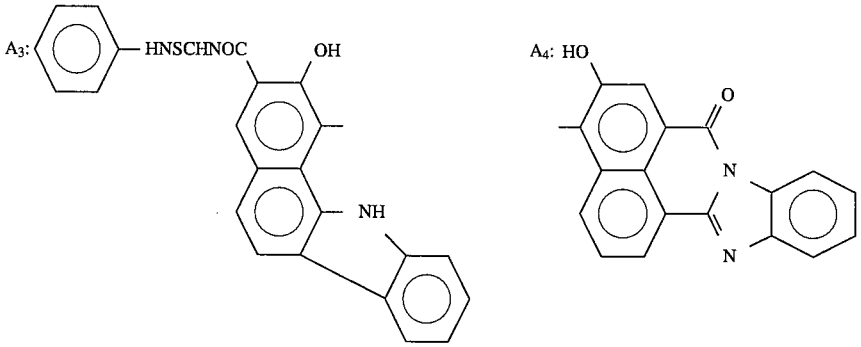
4-9 m: 3

-continued
Fundamental structural formula 4 (for the formula (2)):
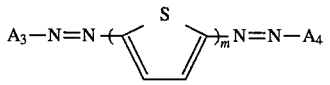
(Ex. Comp. No.)
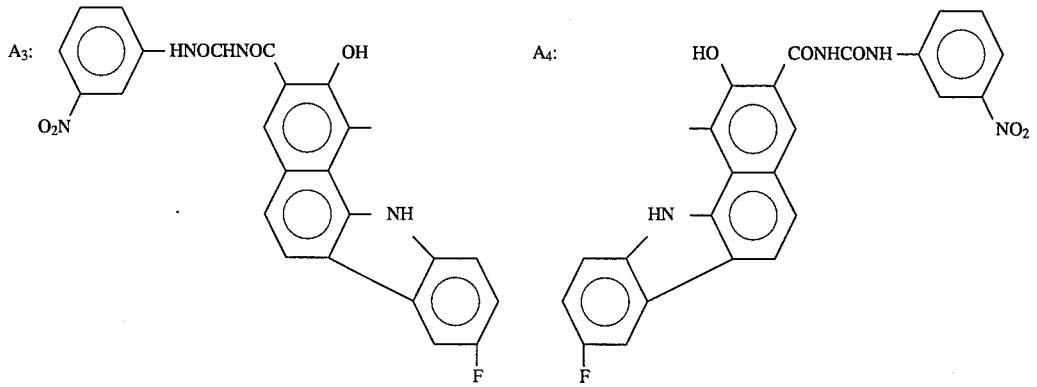
4-10 m: 3
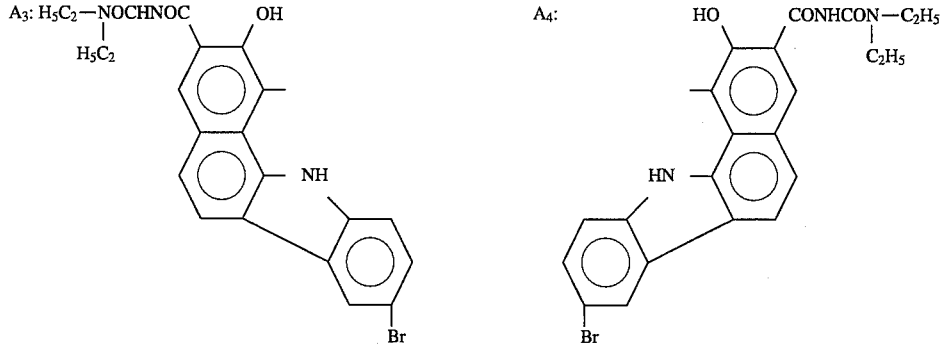
4-11 m: 3
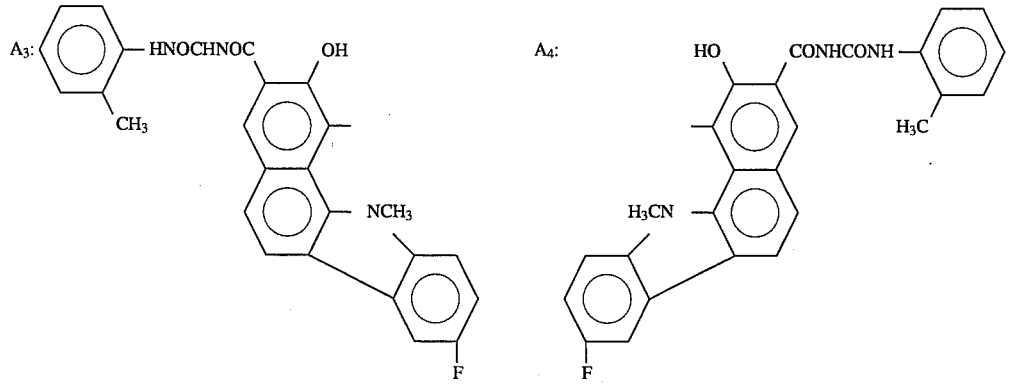
4-12 m: 3

-continued
Fundamental structural formula 4 (for the formula (2)):
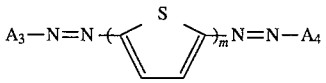
(Ex. Comp. No.)
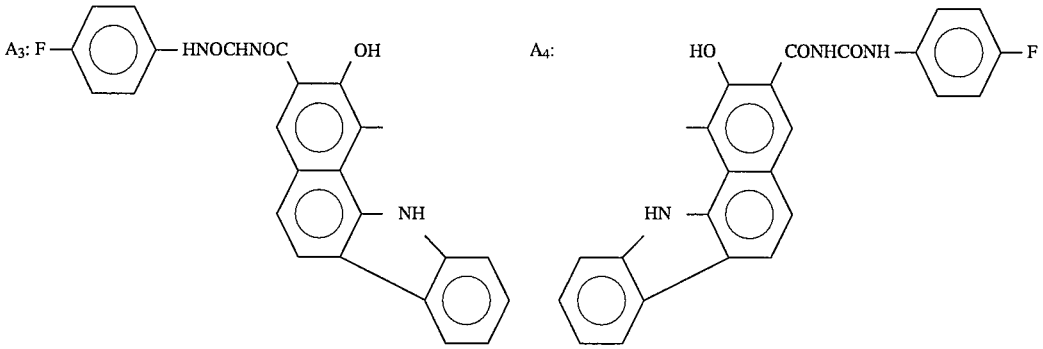
4-13 m: 4
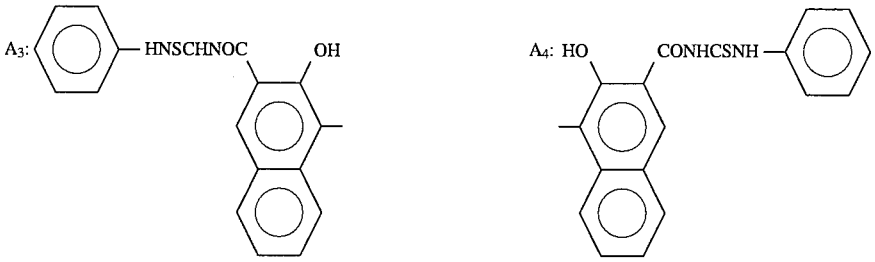
4-14 m: 4
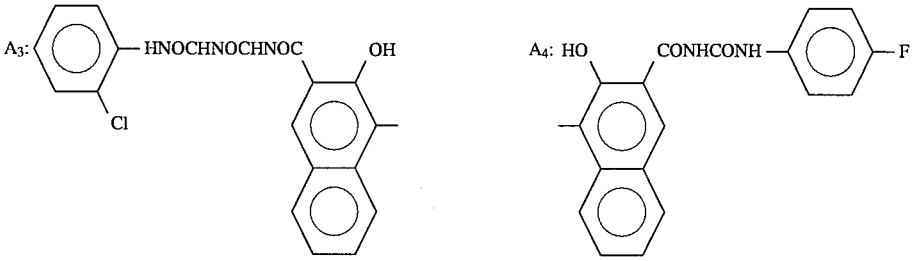
4-15 m: 4
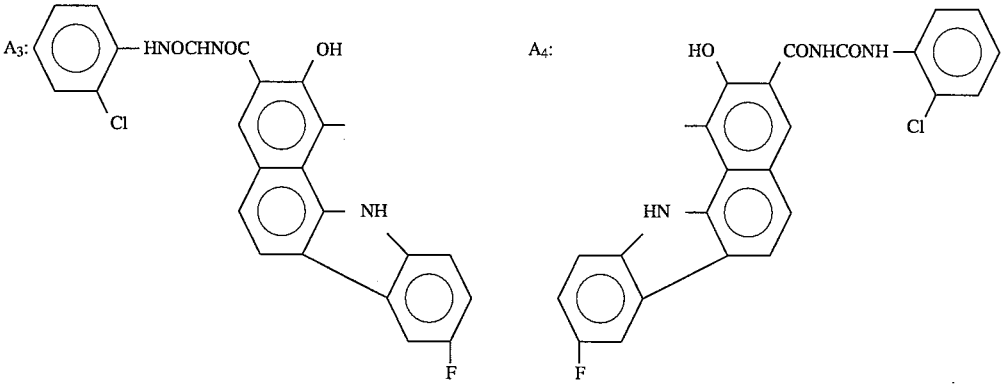
4-16 m: 4

-continued
Fundamental structural formula 4 (for the formula (2)):
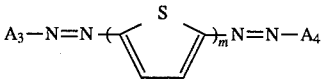
(Ex. Comp. No.)
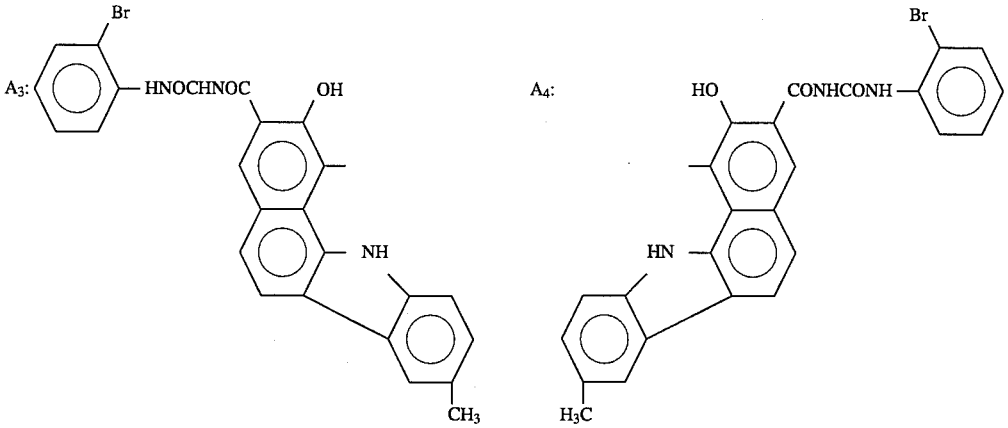
4-17 m: 5
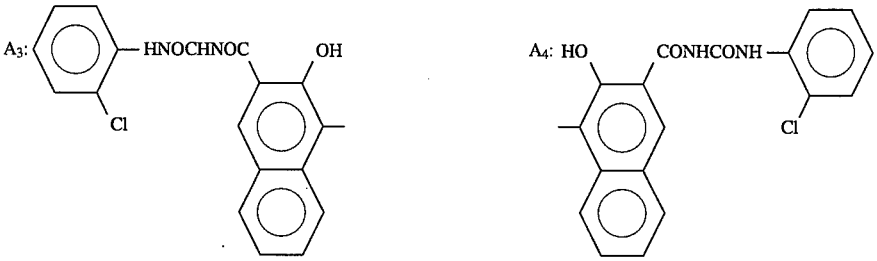
4-18 m: 5
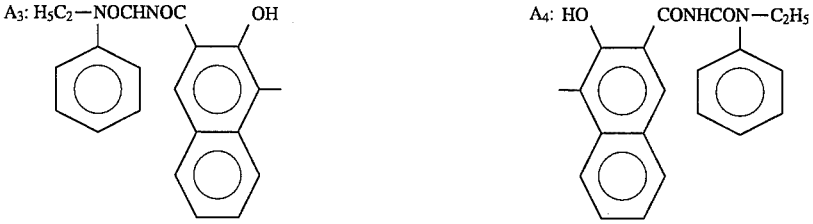
4-19 m: 5
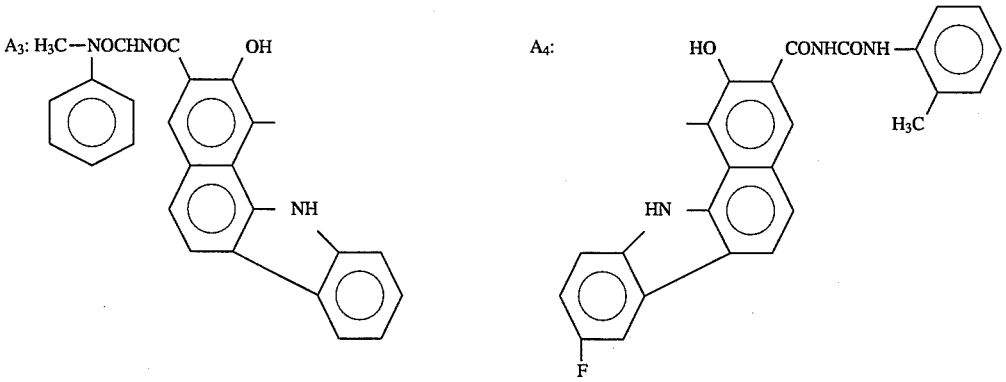

-continued
Fundamental structural formula 4 (for the formula (2)):
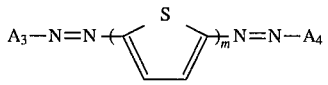
(Ex. Comp. No.)
4-20 m: 5
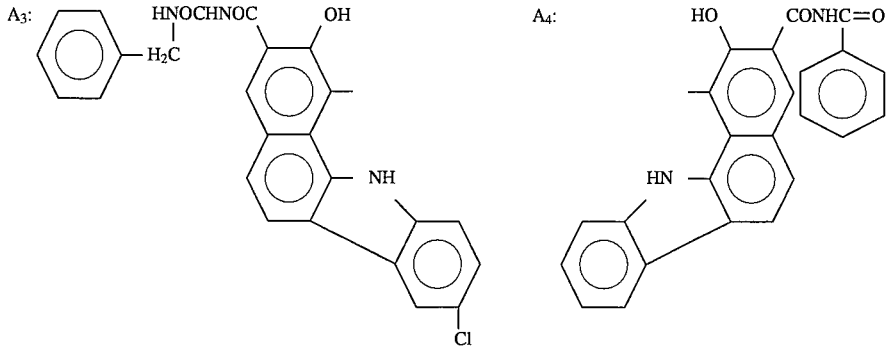
4-21 m: 5
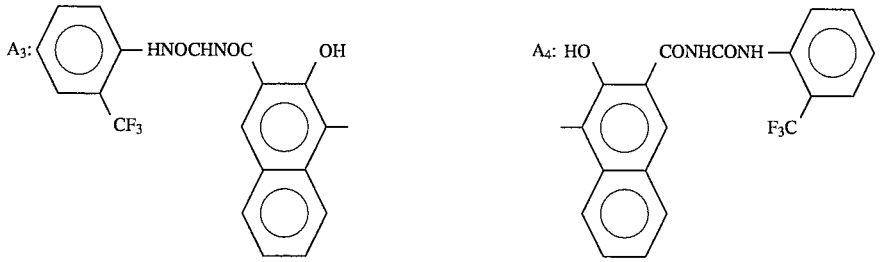
4-22 m: 6
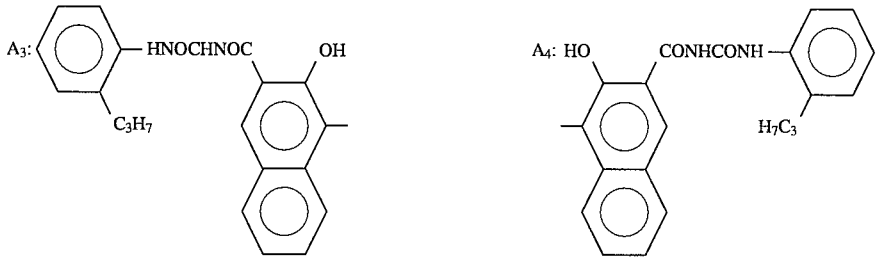
4-23 m: 6
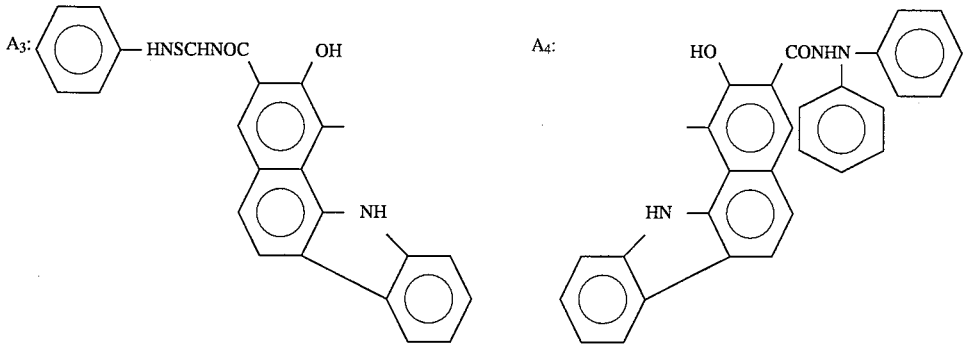
4-24 m: 6

-continued
Fundamental structural formula 4 (for the formula (2)):
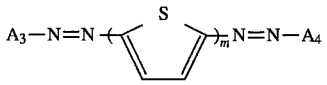
(Ex. Comp. No.)
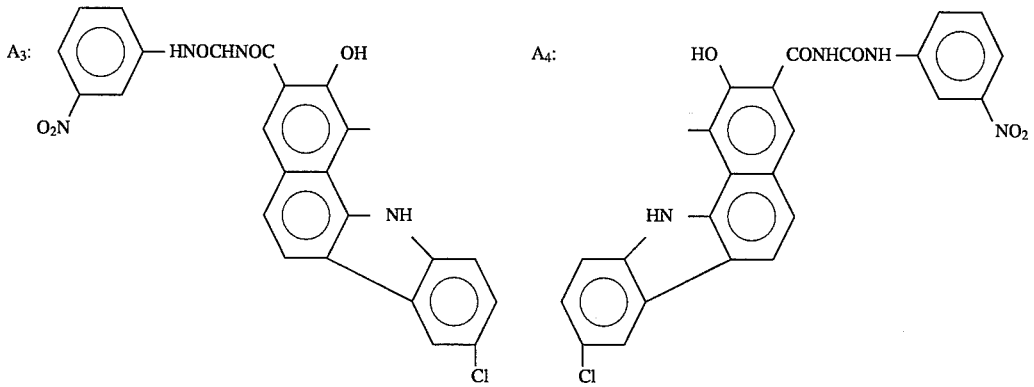
4-25 m: 7
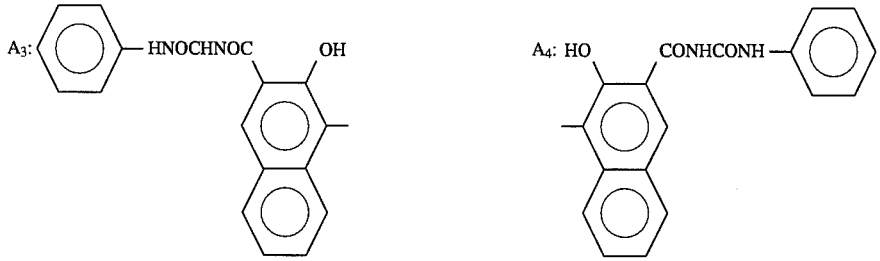
4-26 m: 7
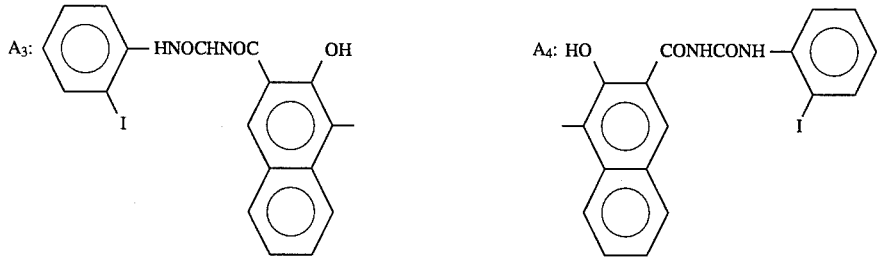
4-27 m: 7
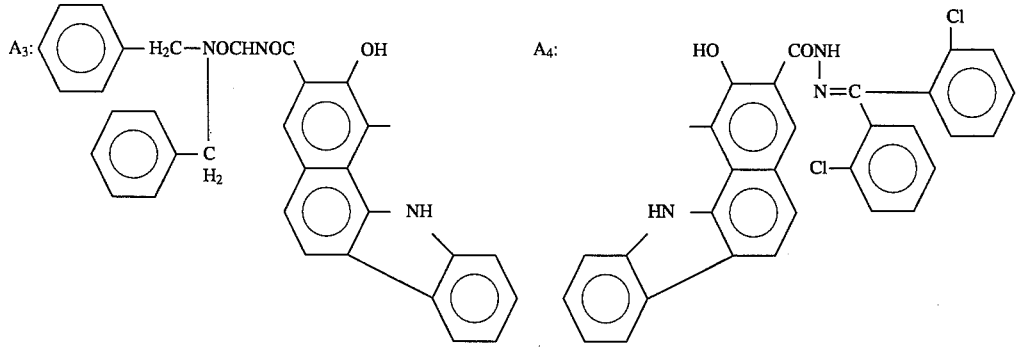
4-28 m: 7

-continued
Fundamental structural formula 4 (for the formula (2)):
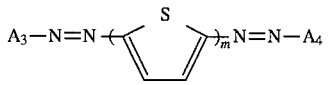
(Ex. Comp. No.)
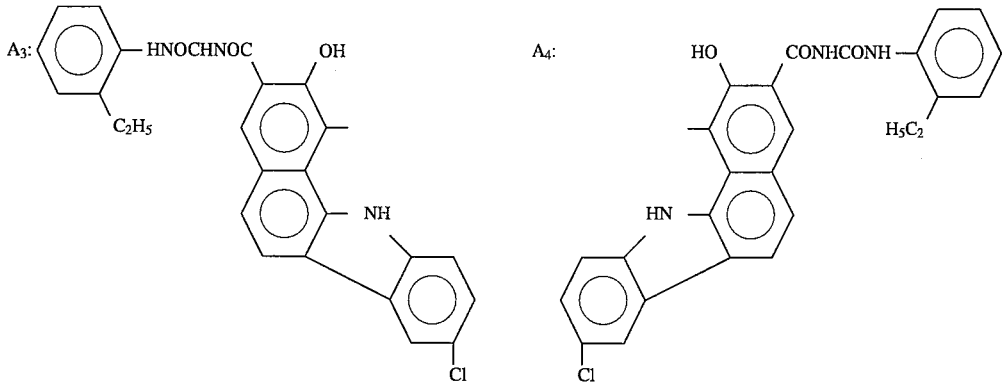
Fundamental structural formula 5 (for the formula (2)):
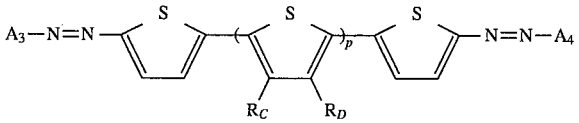
(Ex. Comp. No.)
5-1 $R_C$: $-CH_3$ $R_D$: $-CH_3$
p: 1
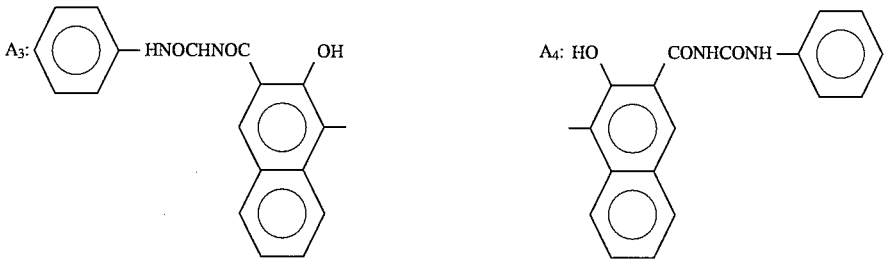
5-2
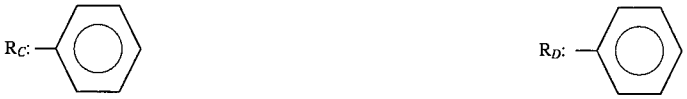
p: 3

-continued

Fundamental structural formula 5 (for the formula (2)):

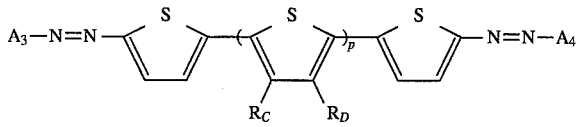

(Ex. Comp. No.)

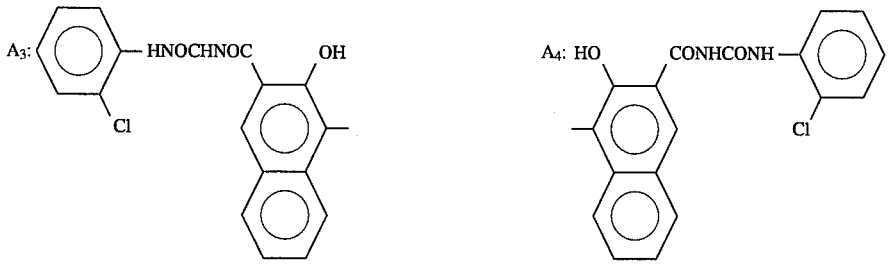

5-3 $R_C$: —Cl p: 5

$R_D$: —Cl

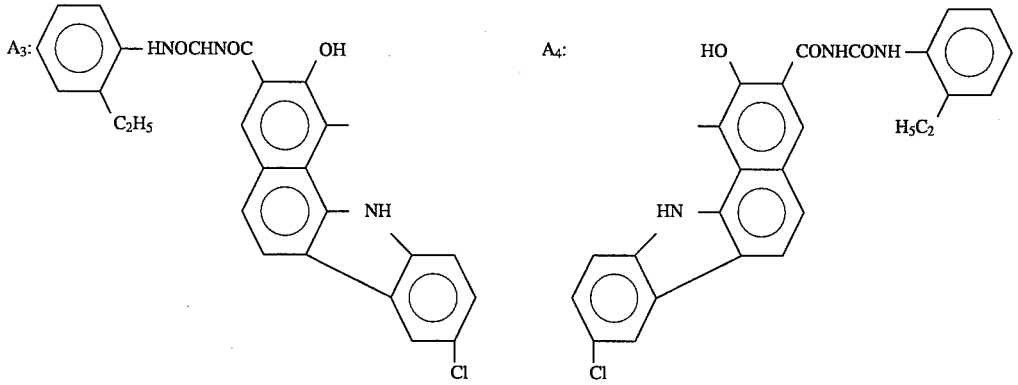

The disazo pigments of the formula (1) and (2) used in the present invention described above may generally be synthesized through a process wherein a corresponding diamine is tetrazotized according to an ordinary method (i.e., tetrazotization reaction) and the resultant tetrazonium salt is reacted with a corresponding coupler in the presence of alkali and aqueous medium (i.e., coupling reaction) or a process wherein a tetrazonium salt as obtained above is converted or modified into a corresponding borofluoride salt or a double salt comprising the tetrazonium salt and zinc chloride and the resultant salt is reacted or coupled with a corresponding coupler in a solvent such as N,N-dimethylformamide (DMF) or dimethyl sulfoxide (DMSO) in the presence of a basic substance such as sodium acetate, triethylamine or N-methylmorpholine. In case where $A_1$ and $A_2$ in the formula (1) or $A_3$ and $A_4$ in the formula (2) are different coupler residues, the disazo pigments of the formulae (1) and (2) may generally be synthesized by first effecting the coupling reaction of 1M (mole) of a tetrazonium salt as obtained above and 1M of one of couplers and then effecting the coupling reaction with 1M of the other coupler or by first mixing 1M of each of two different couples and then effecting coupling reaction together with a tetrazonium salt as obtained above.

Synthesis Example 1

(Production of Ex. Comp. No. 1-1)

150 ml of water, 20 ml (0.23M) of concentrated hydrochloric acid and 8.4 g (0.032M) of a diamine compound of the formula:

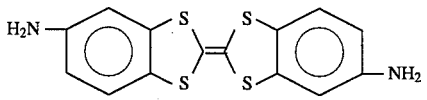

were placed in 300 ml-beaker and cooled to 0° C. To the mixture, a solution of 4.6 g (0,067M) of sodium nitrite in 10 ml of water was added dropwise in 10 minutes at 5° C., followed by stirring for 15 minutes. The reaction mixture was subjected to filtration with carbon. To the resultant filtrate, a solution of 10.5 g (0.096M) of sodium borofluoride in 90 ml of water was added dropwise under stirring. The precipitated borofluoride salt was recovered by filtration and washed with cool water, followed by washing with acetonitrile and drying or distillation at room temperature under reduced pressure to obtain 12.4 g of a purified borofluoride salt (Yield: 84%).

Then, in 500 ml of DMF placed in 1 liter-beaker, 14.3 g (0.042M) of a coupler of the formula:

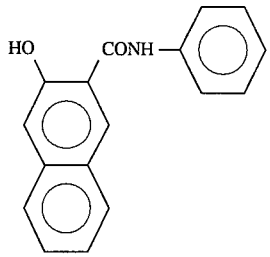

was dissolved, followed by cooling to 5° C. In the solution, 9.2 g (0.02M) of the above-prepared borofluoride salt was dissolved, followed by dropwise addition of 5.1 g (0.050M) of triethylamine in 5 minutes and stirring for 2 hours. After the reaction, the reaction mixture was subjected to filtration to recover a precipitated pigment. The resultant pigment was washed four times with DMF and three times with water, followed by freeze-drying to obtain 17.0 g of an objective pigment (Yield: 90%).

Synthesis Example 2

(Production of Ex. Comp. No. 4-1)

150 ml of water, 20 ml (0.23M) of concentrated hydrochloric acid and 6.3 g (0.032M) of a diamine compound of the formula:

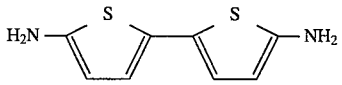

were placed in 300 ml-beaker and cooled to 0° C. To the mixture, a solution of 4.6 g (0.067M) of sodium nitrite in 10 ml of water was added dropwise in 10 minutes at 5° C., followed by stirring for 15 minutes. The reaction mixture was subjected to filtration with carbon. To the resultant filtrate, a solution of 10.5 g (0.096M) of sodium borofluoride in 90 ml of water was added dropwise under stirring. The precipitated borofluoride salt was recovered by filtration and washed with cool water, followed by washing with acetonitrile and drying or distillation at room temperature under reduced pressure to obtain 10.8 g of a purified borofluoride salt (Yield: 86%).

Then, in 500 ml of DMF placed in 1 liter-beaker, 14.3 g (0.042M) of a coupler of the formula:

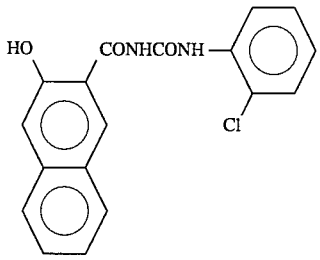

was dissolved, followed by cooling to 5° C. In the solution, 7.9 g (0.02M) of the above-prepared borofluoride salt was dissolved, followed by dropwise addition of 5.1 g (0.050M) of triethylamine in 5 minutes and stirring for 2 hours. After the reaction, the reaction mixture was subjected to filtration to recover a precipitated pigment. The resultant pigment was washed four times with DMF and three times with water, followed by freeze-drying to obtain 16.2 g of an objective pigment (Yield: 90%).

The photosensitive member according to the present invention includes a photosensitive layer containing a disazo pigment represented by the formula (1) or (2) disposed on an electroconductive support. In the present invention, the photosensitive layer may be formed in any known structure including a single layer structure and a lamination structure.

In a preferred embodiment of the present invention, the photosensitive layer may be function-separated into a charge generation layer and a charge transport layer disposed on the charge generation layer (i.e., lamination structure), and the charge generation layer contains the above-mentioned disazo pigment as a charge-generating material.

In the present invention, the charge generation layer may be formed by vapor-depositing the disazo pigment on the electroconductive support or by dispersing the disazo pigment in an appropriate solution containing a binder resin, applying the resultant coating liquid onto, e.g., the electroconductive support by means of a known coating method such as dipping, wire bar coating, spray coating or blade coating and then drying the coating. The charge generation layer may preferably have a thickness of at most 5 μm, particularly 0.1–1 μm. Examples of the binder resin used may be selected from various resins having insulating properties or organic photoconductive polymers and may preferably include polyvinyl butyral, polyvinyl benzal, polyarylate, polycarbonate, poyester, phenoxy resins, cellulosic resins, acrylic resins and polyurethane. The binder resin may preferably be used in a proportion of at most 80 wt. %, particularly at most 40 wt. % based on a total weight of the charge generation layer. Examples of the solvent used may be selected from those dissolving the above-mentioned binder resin and may preferably include: ethers such as tetrahydrofuran and 1,4-dioxane; ketones such as cyclohexanone and methyl ethyl ketone; amides such as N,N-dimethylformamide; esters such as methyl acetate and ethyl acetate; aromatic compounds such as toluene, xylene and chlorobenzene; alcohols such as methanol, ethanol and 2-propanol; and aliphatic halogenated hydrocarbons such as chloroform and methylene chloride. The solvent may preferably be selected from those which do not substantially dissolve the charge transport layer or a primer (or undercoating) layer described hereinafter.

The charge transport layer used in the invention may be disposed on or under the charge generation layer and contains a charge-transporting material having the function of receiving charge carriers from the charge generation layer and transporting the charge carriers under an electric field.

The charge transport layer according to the present invention may preferably be formed by dissolving the charge-transporting material in an appropriate solvent together with a binder resin as desired, applying the resultant coating liquid such as solution onto a predetermined surface (e.g., the surface of an electroconductive substrate, charge generation layer, etc.) by the above-mentioned coating method, and then drying the resultant coating.

The charge transport layer may preferably have a thickness of 5.40 μm, particularly 1.5–3.0 μm.

The charge-transporting material includes an electron-transporting material and a hole-transporting material.

Examples of the electron-transporting material may include: an electron attractive substance such as 2,4,7-trinitrofluorenone, 2,4,5,7-tetranitrofluorenone, chloranil or tetracyanoquinone-dimethane; and polymerized these substances. Examples of the hole-transporting material may include: polycyclic aromatic compounds such as pyrene and anthracene; heterocyclic compounds such as carbazoles, indoles, imidazole, oxazoles, thiazoles, oxadiazoles, pyrazoles, pyrazolines, thiadiazoles and triazole; hydrazone compounds such as p-diethylamionobenzaldehyde-N,N-diphenylhydrazone and N,N-diphenylhydrazino-3-methylidyne-9-ethylcarbazole; styryl-type compounds such as α-phenyl-4'-N,N-diphenylaminostilbene and 5-[4-(di-p-tolylamino)benzylidene]-5H-dibenzo-[a,d]-cycloheptene; benzidines; triarylmethanes; triarylamines; and polymers having a group containing a group derived from the above-mentioned compounds at a main chain or a lateral chain, such as poly-N-vinylcarbazole and polyvinylanthracene. It is possible to use inorganic materials such as selenium, selenium-tellurium, amorphous silicon and cadmium sulfide as the charge-transporting material. The above-mentioned charge-transporting material may be used singly or in combination of two or more species. When the charge-transporting material does not have film-forming properties, it is possible to use an appropriate binder resin together therewith.

Examples of such a binder resin to be used for forming the charge transport layer may include: insulating polymers such as acrylic resins, polyarylate, polyester, polycarbonate, polystyrene, acrylonitrile-styrene copolymers, polyacrylamide, polyamide and chlorinated rubber; and organic photoconductive polymers such as poly-N-vinylcarbazole and polyvinylanthracene. The binder resin may preferably be used in a proportion of 20–90 wt. %, particularly 40–70 wt. % based on a total weight of the charge transport layer.

In another embodiment of the present invention, the photosensitive layer may be composed of a single layer comprising the above-mentioned disazo pigment and the above-mentioned charge-transporting material. In this instance, it is possible to use a charge transfer complex comprising poly-N-vinylcarbazole and trinitrofluorenone as the charge-transporting material. The photosensitive layer may be formed by dispersing and dissolving the disazo pigment and the charge transfer complex in an appropriate solvent together with a binder resin, applying the resultant coating liquid onto the electroconductive support by the above-mentioned coating method and then drying the coating. In this instance, examples of the solvent used and the binder resin used may include those described hereinabove.

The thickness of the photosensitive layer which is composed of a single layer may preferably be 5–40 microns, more preferably 15–30 microns. The binder resin used for forming the single layer-type photosensitive layer may preferably be used in a similar proportion as those in the lamination-type photosensitive layer described above.

In any photosensitive member according to the present invention, the disazo pigment of the formula (1) or (2) may be used singly or in combination with two or more species thereof. Further, it is possible to use the disazo pigment of the formula (1) or (2) in combination with at least one known charge-generating material.

The electroconductive support used in the present invention may include aluminum, aluminum alloy, copper, zinc, stainless steel, vanadium, molybdenum, chromium, titanium, nickel, indium, gold and platinum. The electroconductive support may also include: a plastic (such as polyethylene, polypropyrene, polyvinyl chloride, polyethylene terephthalate or acrylic resins) coated with, e.g., a vacuum vapor-deposited layer of the above-mentioned metal or alloy; a plastic, metal or alloy coated with a layer comprising a mixture of an electroconductive powder (such as carbon black or silver particles) and an appropriate binder resin; and a plastic or paper impregnated with electroconductive particles. The electroconductive support may be in any form such as drum, sheet, film, belt, etc., and may preferably assume a shape suitably adapted to an electrophotographic apparatus to be used therewith.

In the present invention, between the electroconductive support and the photosensitive layer, it is possible to form a primer or undercoat layer having a barrier function and an adhesive function. The thickness of the undercoat layer may preferably be at most 5 μm, particularly 0.1 to 3 μm. The undercoat layer may comprise, e.g., casein, polyvinyl alcohol, nitrocellulose, polyamide (e.g., nylon 6, nylon 66, nylon 610, copolymer nylon, alkoxymethylated nylon, etc.), polyurethane or aluminum oxide.

In order to protect the photosensitive layer from external mechanical shock or external chemical action, a protective layer can further be disposed on the photosensitive layer. Such a protective layer may comprise a resin, or a resin containing conductive particles or a charge-transporting material.

The electrophotographic photosensitive member according to the present invention can be applied to not only an ordinary electrophotographic copying machine but also a facsimile machine, a laser beam printer, a light-emitting diode (LED) printer, a cathode-ray tube (CRT) printer, a liquid crystal printer, and other fields of applied electrophotography including, e.g., laser plate making.

FIG. 1 shows a schematic structural view of an electrophotographic apparatus including a process cartridge using an electrophotographic photosensitive member of the invention. Referring to FIG. 1, a photosensitive drum (i.e., photosensitive member) 1 as an image-carrying member is rotated about an axis 2 at a prescribed peripheral speed in the direction of the arrow shown inside of the photosensitive drum 1. The surface of the photosensitive drum is uniformly charged by means of a primary charger (charging means) 3 to have a prescribed positive or negative potential. The photosensitive drum 1 is exposed to light-image 4 (as by slit exposure or laser beam-scanning exposure) by using an image-exposure means (not shown), whereby an electrostatic latent image corresponding to an exposure image is successively formed on the surface of the photosensitive drum 1. The electrostatic latent image is developed by a developing means 5 to form a toner image. The toner image is successively transferred to a transfer material 7 which is supplied from a supply part (not shown) to a position between the photosensitive drum 1 and a transfer charger (transfer means) 6 in synchronism with the rotating speed of the photosensitive drum 1, by means of the transfer charger 6. The transfer material 7 with the toner image thereon is separated from the photosensitive drum 1 to be conveyed to a fixing device (image-fixing means) 8, followed by image fixing to print out the transfer material 7 as a copy product outside the electrophotographic apparatus. Residual toner particles on the surface of the photosensitive drum 1 after the transfer are removed by means of a cleaner (cleaning means) 9 to provide a cleaned surface, and residual charge on the surface of the photosensitive drum 1 is erased by a pre-exposure light 10 emitted from a pre-exposure means (not shown) to prepare for the next cycle. In case where the primary charging means 3 is a contact charging means such as a charging roller, the pre-exposure step may be omitted.

According to the present invention, in the electrophotographic apparatus, it is possible to provide a process cartridge 11 which includes plural means inclusive of or selected from the photosensitive member (photosensitive drum) 1, the charging means 3, the developing means 5, the cleaning means 9, etc. so as to be attached (or connected) to or removed (or released) from an apparatus body of the electrophotographic apparatus such as a copying machine or a laser beam printer, as desired. The process cartridge 11 may, for example, be composed of the photosensitive member and at least one device of the charging means 3, the developing means 5 and the cleaning means 9 which are integrally supported to prepare a single unit capable of being connected to or released from the body of the electrophotographic apparatus by using a guiding means such as a rail 12 in the body.

In case where the electrophotographic apparatus is used as a copying machine or a printer, image-exposure light 4 may be given by reading data on reflection light or transmitted light from an original or by reading data on the original by a sensor, converting the data into a signal and then effecting a laser beam scanning, a drive of LED array or a drive of a liquid crystal shutter array so as to expose the photosensitive member with the light 4.

Figure 2:
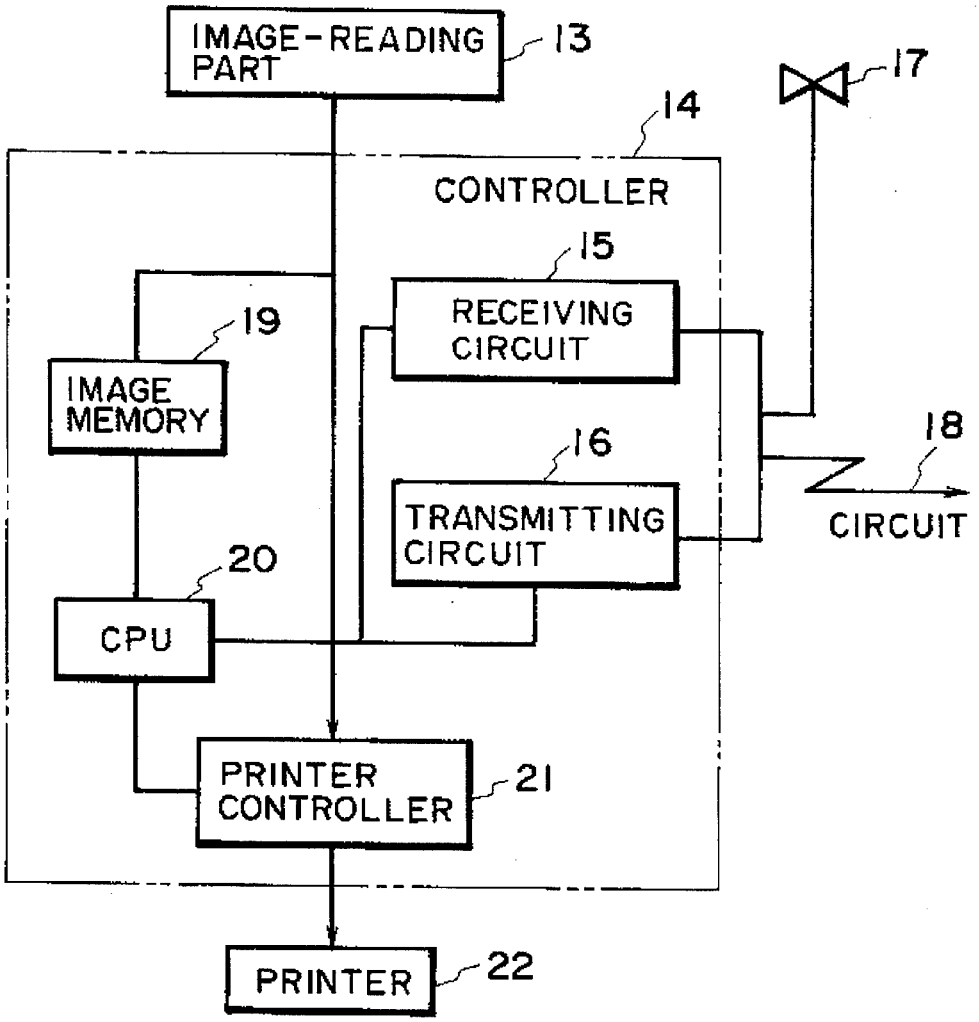
FIG. 2 is a block diagram of a facsimile machine using an electrophotographic apparatus according to the present invention as a printer.

In case where the electrophotographic apparatus according to the present invention is used as a printer of a facsimile machine, image-exposure light 4 is given by exposure for printing received data. FIG. 2 shows a block diagram of an embodiment for explaining this case. Referring to FIG. 2, a controller 14 controls an image-reading part 13 and a printer 22. The whole controller 14 is controlled by a CPU (central processing unit) 20. Read data from the image-reading part 13 is transmitted to a partner station through a transmitting circuit 16, and on the other hand, the received data from the partner station is sent to the printer 22 through a receiving circuit 15. An image memory memorizes prescribed image data. A printer controller 21 controls the printer 22, and a reference numeral 17 denotes a telephone handset.

The image received through a circuit 18 (the image data sent through the circuit from a connected remote terminal) is demodulated by means of the receiving circuit 15 and successively stored in an image memory 19 after a restoring-signal processing of the image data. When image for at least one page is stored in the image memory 19, image recording of the page is effected. The CPU 20 reads out the image data for one page from the image memory 19 and sends the image data for one page subjected to the restoring-signal processing to the printer controller 21. The printer controller 21 receives the image data for one page from the CPU 20 and controls the printer 22 in order to effect image-data recording. Further, the CPU 20 is caused to receive image for a subsequent page during the recording by the printer 22. As described above, the receiving and recording of the image are performed.

Hereinbelow, the present invention will be explained more specifically with reference to examples.

EXAMPLE 1

Onto an aluminum substrate, a solution of 5 g of an N-methoxymethylated nylon resin (Mn (number-average molecular weight)=32,000) and 10 g of an alcohol-soluble copolymer nylon resin (Mn=29,000) in 95 g of methanol was applied by means of a wire bar, followed by drying to form a 1 micron-thick undercoating layer.

Separately, 5 g of a disazo pigment (Example Compound No. 1-2) was added to a solution of 2 g of polyvinylbenzal (benzal degree=above 75%, Mn=80,000) in 95 g of cyclohexanone and the resultant mixture was dispersed for 20 hours by means of a sand mill to prepare a coating liquid. The coating liquid was applied onto the above-prepared undercoating layer formed on the aluminum plate by means of a wire bar to form a charge generation layer having a thickness (after drying) of 0.2 micron.

Then, 5 g of a styryl compound of the formula:

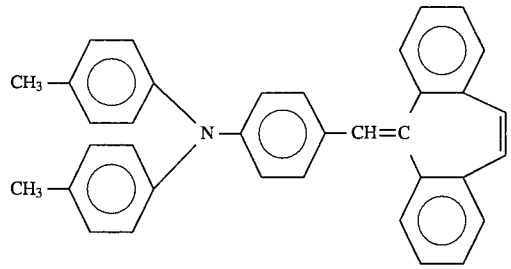

and 5 g of polymethylmetacrylate (Mn=100,000) were dissolved in 40 g of chlorobenzene to prepare a coating liquid.

The coating liquid was applied onto the above-mentioned charge generation layer by means of a wire bar to form a charge transport layer having a thickness (after drying) of 20 microns, whereby an electrophotographic photosensitive member was prepared.

The thus prepared photosensitive member was negatively charged by using corona (−5 KV) according to a static method by means of an electrostatic copying paper tester (Model: SP-428, mfd. by Kawaguchi Denki K.K.) and retained in a dark place for 1 sec. Thereafter, the photosensitive member was exposed to halogen light at an illuminance of 10 lux, to evaluate the charging characteristic. More specifically, in order to evaluate the charging characteristic, the surface potential ($V_0$) immediately after the charging and the exposure quantity ($E_{1/2}$) (i.e., sensitivity) required for decreasing the potential obtained after a dark decay of 1 sec to ½ thereof were measured.

The results are shown in Table 1 appearing hereinafter.

EXAMPLES 2–26

Photosensitive members were prepared and evaluated in the same manner as in Example 1 except that the disazo pigments shown in Table 1 below were used instead of the disazo pigment (Ex. Comp. No. 1-2), respectively. The results are shown in the following Table 1.

TABLE 1

| Ex. No. | Ex. Comp. No. | $V_0$ (−V) | $E_{1/2}$ (lux · sec) |
|---|---|---|---|
| 1 | 1-2 | 695 | 1.4 |
| 2 | 1-4 | 700 | 1.2 |
| 3 | 1-6 | 705 | 2.3 |
| 4 | 1-9 | 705 | 0.9 |
| 5 | 1-10 | 700 | 1.0 |
| 6 | 1-12 | 700 | 1.9 |
| 7 | 1-13 | 690 | 1.6 |
| 8 | 1-15 | 695 | 2.4 |
| 9 | 1-19 | 705 | 1.1 |
| 10 | 1-20 | 700 | 1.3 |
| 11 | 2-1 | 700 | 1.4 |
| 12 | 2-3 | 705 | 1.9 |
| 13 | 3-2 | 690 | 2.5 |
| 14 | 4-1 | 695 | 1.0 |
| 15 | 4-4 | 700 | 2.4 |
| 16 | 4-9 | 700 | 1.4 |
| 17 | 4-12 | 685 | 1.3 |
| 18 | 4-15 | 690 | 0.9 |
| 19 | 4-19 | 690 | 2.0 |
| 20 | 4-21 | 705 | 2.5 |
| 21 | 4-24 | 690 | 1.3 |
| 22 | 4-25 | 695 | 1.9 |
| 23 | 4-28 | 685 | 0.9 |

TABLE 1-continued

| Ex. No. | Ex. Comp. No. | $V_0$ (−V) | $E_{1/2}$ (lux · sec) |
|---|---|---|---|
| 24 | 5-1 | 695 | 1.7 |
| 25 | 5-2 | 700 | 2.4 |
| 26 | 5-3 | 710 | 2.6 |

Comparative Examples 1–3

Three species of photosensitive members were prepared and evaluated in the same manner as in Example 1 except that the following comparative pigments A to C were used instead of the disazo pigment (Ex. Comp. No. 1-2), respectively. (Comparative pigment A: disclosed in JP-A 2-84659)

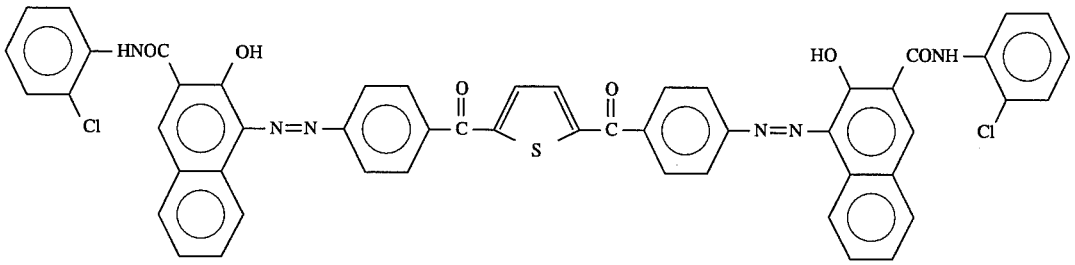

(Comparative pigment B: disclosed in JP-A 3-177143)

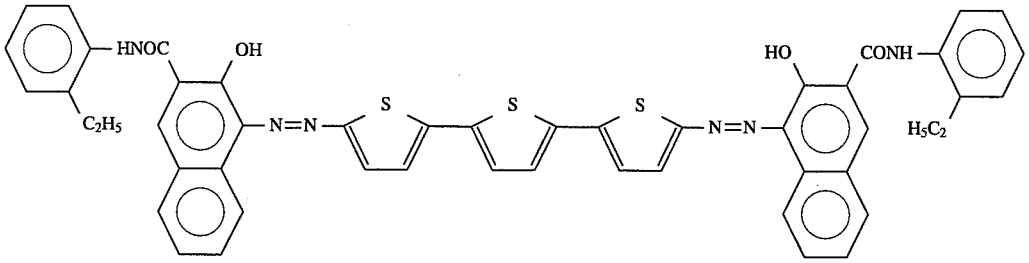

(Comparative pigment C)

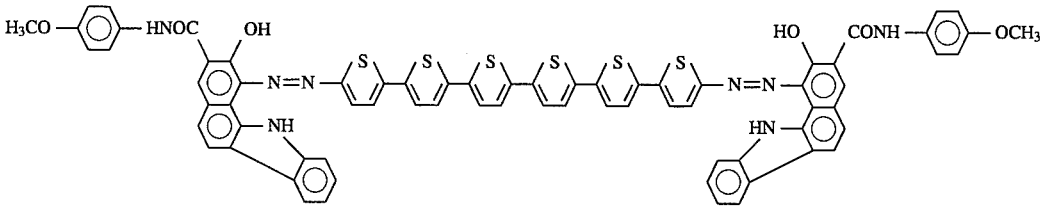

The results are shown in the following Table 2.

TABLE 2

| Comp. Ex. No. | Comp. Comp No. | $V_0$ (−V) | $E_{1/2}$ (lux · sec) |
|---|---|---|---|
| 1 | A | 640 | 5.1 |
| 2 | B | 700 | 4.8 |
| 3 | C | 690 | 3.9 |

EXAMPLE 27

A photosensitive member prepared in Example 1 was attached to the cylinder for a photosensitive drum to be used for an electrophotographic copying apparatus equipped with a corona charger (−6.5 KV), an exposure optical system, a developing means, a transfer charger, an exposure optical system for erasing residual charge, and a cleaner. After a dark part potential ($V_D$) and a light part potential ($V_L$) at the initial stage were set to −700 V and −200 V, respectively, the electrophotographic copying apparatus was subjected to a copying test (a durability test) of 5,000 sheets. Thus, $V_D$ and $V_L$ were measured after the copying test of 5,000 sheets to evaluate variations in these potentials ($\Delta V_D$ and $\Delta V_L$).

The results are shown in Table 3 appearing below. In Table 3, a negative value means a decrease in an absolute value of the potentials and a positive value means an increase in an absolute value of the potentials.

EXAMPLES 28–36

Photosensitive members prepared in Examples 2, 5, 7, 9, 11, 14, 17, 18, 21 and 24 were evaluated in the same manner as in Example 27. The results are shown in Table 3 below.

TABLE 3

| Ex. No. | Ex. Comp. No. | $\Delta V_D$ (V) | $\Delta V_L$ (V) |
|---|---|---|---|
| 27 | 1-4 | −5 | +5 |
| 28 | 1-10 | −10 | 0 |
| 29 | 1-13 | −15 | −5 |
| 30 | 1-19 | −10 | 0 |
| 31 | 2-1 | 0 | +5 |
| 32 | 4-1 | −5 | +15 |
| 33 | 4-12 | −10 | 0 |
| 34 | 4-15 | −5 | +10 |
| 35 | 4-24 | 0 | +10 |
| 36 | 5-1 | −10 | +10 |

Comparative Examples 4 and 5

Two photosensitive members prepared in Comparative Examples 1 and 2 were evaluated in the same manner as in Example 27. The results are shown in Table 4 below.

TABLE 4

| Comp. Ex. No. | Comp. Comp. No. | $\Delta V_D$ (V) | $\Delta V_L$ (V) |
|---|---|---|---|
| 4 | A | −25 | +55 |
| 5 | B | −35 | +80 |

EXAMPLE 37

A 0.5 micron-thick undercoating layer of polyvinylalcohol (number-average polymerization degree=22,000) was formed on an aluminum-deposited polyethylene terephthalate film. Separately, 5 g of a disazo pigment (Ex. Comp. No. 1-9) was added to a solution of 2 g of polyvinylbutyral (butyral degree=63 mol. %, Mn=22,000) in 95 g of cyclohexanone and the resultant mixture was dispersed for 20 hours by means of a sand mill to prepare a coating liquid. The coating liquid was applied onto the above-prepared undercoating layer and dried to form a 0.2 micron-thick charge generation layer.

Then, 5 g of a hydrazone compound of the formula:

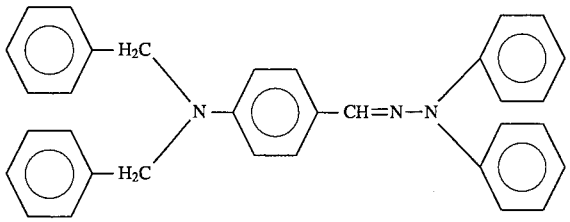

and 5 g of a polycarbonate resin (Mw (weight-average molecular weight)=55,000) were dissolved in 40 g of tetrahydrofuran (THF) to prepare a coating liquid. The coating liquid was applied onto the above-mentioned charge generation layer and dried to form a 20 micron-thick charge transport layer, whereby an electrophotographic photosensitive layer was prepared.

The thus prepared photosensitive member was subjected to evaluation of the charging characteristic and the durability in the same manner as in Examples 1 and 27.

The results are shown below.

$V_0$: −695 V, $E_{1/2}$: 1.8 lux.sec $\Delta V_D$: +5 V, $\Delta V_L$: +5 V

EXAMPLE 38

A photosensitive member was prepared in the same manner as in Example 37 except for using a disazo pigment (Ex. Comp. No. 4-17) instead of the disazo pigment (Ex. Comp. No. 1-9).

The thus prepared photosensitive member was evaluated in the same manner as in Example 37, whereby the following results were obtained.

$V_0$: −695 V, $E_{1/2}$: 1.8 lux.sec $\Delta V_D$: 0 V, $\Delta V_L$: +10 V

EXAMPLE 39

A 0.5 micron-thick undercoating layer of polyvinylalcohol (Mn=22,000) was formed on an aluminum-deposited polyethylene terephthalate film. Separately, 5 g of a disazo pigment (Ex. Comp. No. 1-13) was added to a solution of 2 g of poly-p-fluorovinylbenzal (benzal degree=75 mol. %, Mn=90,000) in 95 g of THF and the resultant mixture was dispersed for 20 hours by means of a sand mill to prepare a coating liquid. The coating liquid was applied onto the above-prepared undercoating layer and dried to form a 0.2 micron-thick charge generation layer.

Then, 5 g of a triarylamine compound of the formula:

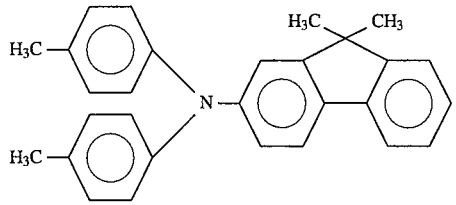

and 5 g of a polycarbonate resin (Mw=55,000) were dissolved in 40 g of chlorobenzene to prepare a coating liquid. The coating liquid was applied onto the above-mentioned charge generation layer and dried to form a 20 micron-thick charge transport layer, whereby an electrophotographic photosensitive layer was prepared.

The thus prepared photosensitive member was subjected to evaluation of the charging characteristic and the durability in the same manner as in Examples 1 and 27.

The results are shown below.

$V_0$: −690 V, $E_{1/2}$: 1.2 lux.sec $\Delta V_D$: 0 V, $\Delta V_L$: +5 V

EXAMPLE 40

A photosensitive member was prepared in the same manner as in Example 39 except for using a disazo pigment (Ex. Comp. No. 4-9) instead of the disazo pigment (Ex. Comp. No. 1-13).

The thus prepared photosensitive member was evaluated in the same manner as in Example 39, whereby the following results were obtained.

$V_0$: −690 V, $E_{1/2}$: 1.7 lux.sec $\Delta V_D$: 0 V, $\Delta V_L$: +5 V

EXAMPLE 41

An electrophotographic photosensitive member was prepared in the same manner as in Example 39 except that the charge generation layer and the charge transport layer was prepared in reverse order. The above-prepared photosensitive member was evaluated in the same manner as in Example 39 except that the photosensitive member was positively charged, whereby the following results were obtained.

$V_0$ +685 V, $E_{1/2}$: 2.0 lux.sec $\Delta V_D$: −5 V, $\Delta V_L$: +10 V

EXAMPLE 42

An electrophotographic photosensitive member was prepared in the same manner as in Example 40 except that the charge generation layer and the charge transport layer was prepared in reverse order. The above-prepared photosensitive member was evaluated in the same manner as in Example 40 except that the photosensitive member was positively charged, whereby the following results were obtained.

$V_0$ +705 V, $E_{1/2}$: 2.3 lux.sec $\Delta V_D$: +5 V, $\Delta V_L$: 0 V

EXAMPLE 43

Up to a charge generation layer was prepared in the same manner as in Example 1. Onto the charge generation layer, a solution of 5 g of 2,4,7-trinitro-9-fluorenone and 5 g of a polycarbonate resin (Mw=30,000) in 50 g of THF was applied by means of a wire bar to form a charge generation layer having a thickness (after drying) of 18 microns, whereby an electrophotographic photosensitive member was prepared.

The thus prepared photosensitive member was evaluated in the same manner as in Example 1 except that the photosensitive member was positively charged, whereby the following results were obtained.

$V_0$: +695 V, $E_{1/2}$: 1.9 lux.sec

EXAMPLE 44

A photosensitive member was prepared in the same manner as in Example 43 except that up to a charge generation layer was prepared in the same manner as in Example 14.

The thus prepared photosensitive member was evaluated in the same manner as in Example 43, whereby the following results were obtained.

$V_0$: +690 V, $E_{1/2}$: 2.1 lux.sec

EXAMPLE 45

0.5 g of a disazo pigment (Ex. Comp. No. 1-2) and 9.5 g of cyclohexanone were dispersed for 5 hours by means of a paint shaker. To the resultant dispersion, a solution of 5 g of a styryl compound used in Example 1 and 5 g of a polycarbonate resin (Mw=80,000) in 40 g of THF was added, followed by shaking for 1 hour to prepare a coating liquid. The coating liquid was applied onto an aluminum support by means of a wire bar and dried to form a 20 micron-thick photosensitive layer, whereby an electrophotographic photosensitive member was prepared.

The thus prepared photosensitive member was evaluated in the same manner as in Example 1 except that the photosensitive member was positively charged, whereby the following results were obtained.

$V_0$: +690 V, $E_{1/2}$: 1.9 lux.sec

EXAMPLE 46

A photosensitive member was prepared in the same manner as in Example 45 except for using a disazo pigment (Ex. Comp. No. 4-11) instead of the disazo pigment (Ex. Comp. No. 1-2).

The thus prepared photosensitive member was evaluated in the same manner as in Example 45, whereby the following results were obtained.

$V_0$: +695 V, $E_{1/2}$: 2.0 lux.sec

What is claimed is:

1. An electrophotographic photosensitive member, comprising: an electroconductive support and a photosensitive layer disposed on the electroconductive support, wherein the photosensitive layer comprises a disazo pigment represented by the formula (1) below or a disazo pigment represented by the formula (2) below:

Formula (1):

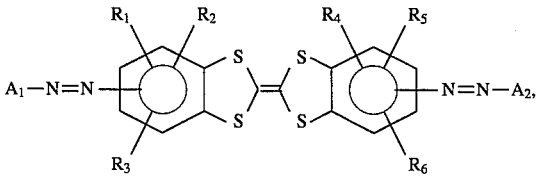

(1)

wherein $R_1$ to $R_6$ independently denote hydrogen atom, halogen atom, alkyl group, alkoxy group or aryl group; and $A_1$ and $A_2$ independently denote a coupler residue having phenolic hydroxyl group, or Formula (2):

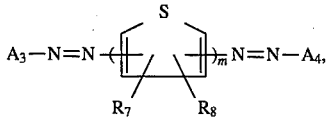

(2)

wherein $R_7$ and $R_8$ independently denote hydrogen atom, halogen atom, alkyl group, alkoxy group or aryl group; $A_3$ and $A_4$ independently denote a coupler residue having phenolic hydroxyl group, and at least one of $A_3$ and $A_4$ is represented by the following formula (3):

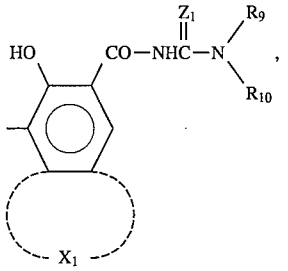

(3)

wherein $X_1$ denotes a residual group for forming polycyclic aromatic ring or polycyclic heterocycle by condensation reaction with benzene ring; $R_9$ and $R_{10}$ independently denote hydrogen atom, alkyl group, aryl group, aralkyl group or heterocyclic group, and $R_9$ and $R_{10}$ can be connected with each other to form cyclic amino group; $Z_1$ denotes oxygen atom or sulfur atom; and m is a positive integer.

2. A member according to claim 1, wherein the photosensitive layer comprises the disazo pigment of the formula (1).

3. A member according to claim 1 or 2, wherein $R_1$ to $R_6$ are hydrogen atom.

4. A member according to claim 1 or 2, wherein the disazo pigment of the formula (1) is represented by the following formula:

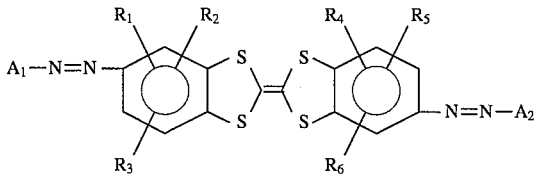

or

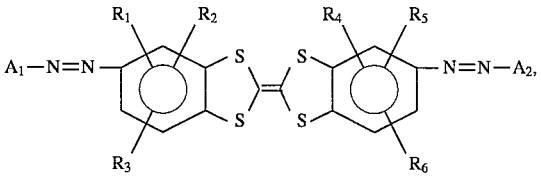

wherein $A_1$, $A_2$ and $R_1$ to $R_6$ have the same meanings as in the formula (1) described above.

5. A member according to claim 1 or 2, wherein the disazo pigment of the formula (1) is represented by the following formula:

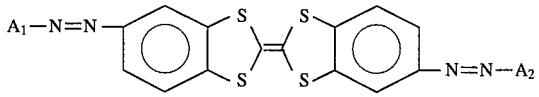

or

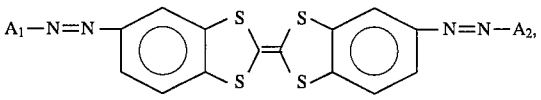

wherein $A_1$ and $A_2$ have the same meanings as in the formula (1) described above.

6. A member according to claim 1 or 2, wherein $A_1$ and $A_2$ are independently selected from the group consisting of coupler residues represented by the formulae (4) to (9) below:

Formula (4):

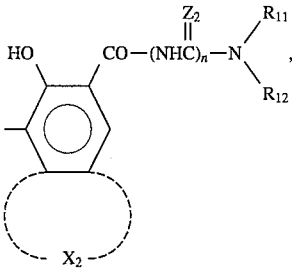

(4)

wherein $X_2$ denotes a residual group for forming polycyclic aromatic ring or polycyclic heterocycle by condensation reaction with benzene ring; $R_{11}$ and $R_{12}$ independently denote hydrogen atom, alkyl group, aryl group, aralkyl group or heterocyclic group, and $R_{11}$ and $R_{12}$ can be connected with each other to form cyclic amino group; $Z_2$ denotes oxygen atom or sulfur atom; and n is 0 or 1;

Example (5):

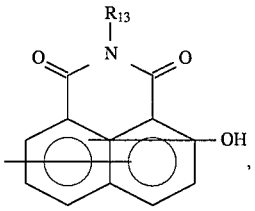

(5)

wherein $R_{13}$ denotes alkyl group, aryl group, aralkyl group or heterocyclic group;

Formula (6):

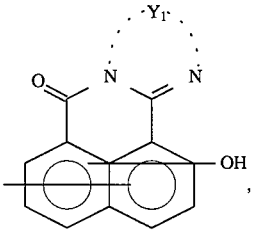

(6)

wherein $Y_1$ denotes arylene group or divalent heterocyclic group;

Formula (7):

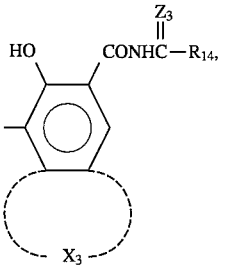

(7)

wherein $X_3$ denotes a residual group for forming polycyclic aromatic ring or polycyclic heterocycle by condensation reaction with benzene ring; $R_{14}$ denotes hydrogen atom, alkyl group, aryl group, aralkyl group or heterocyclic group; and; $Z_3$ denotes oxygen atom or sulfur atom;

Formula (8):

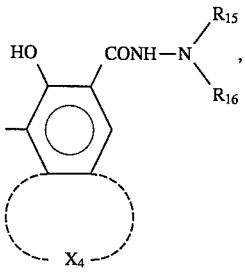

(8)

wherein $X_4$ denotes a residual group for forming polycyclic aromatic ring or polycyclic heterocycle by condensation reaction with benzene ring; and $R_{15}$ and $R_{16}$ independently denote hydrogen atom, alkyl group, aryl group, aralkyl group or heterocyclic group, and $R_{15}$ and $R_{16}$ can be connected with each other to form cyclic amino group; and Formula (9):

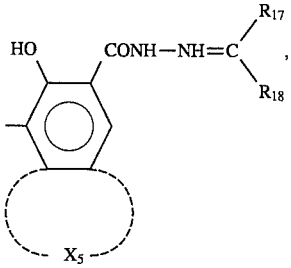

(9)

wherein $X_5$ denotes a residual group for forming polycyclic aromatic ring or polycyclic heterocycle by condensation reaction with benzene ring; and $R_{17}$ and $R_{18}$ independently denote hydrogen atom, alkyl group, aryl group, aralkyl group or heterocyclic group, and $R_{17}$ and $R_{18}$ can be connected with each other to form cyclic group.

7. A member according to claim 6, wherein $A_1$ and $A_2$ are independently selected from the group consisting of coupler residues represented by the formulae (4), (7), (8) and (9) in which $X_2$ to $X_5$ each are a residual group for forming benzocarbazole ring by condensation reaction with benzene ring.

8. A member according to claim 1 or 2, wherein the photosensitive layer comprises a charge generation layer comprising the disazo pigment as a charge-generating material and comprises a charge transport layer, and the charge transport layer is disposed on the charge generation layer.

9. A member according to claim 1, wherein the photosensitive layer comprises the disazo pigment of the formula (2).

10. A member according to claim 1 or 9, wherein $R_7$ and $R_8$ are hydrogen atom.

11. A member according to claim 1 or 9, wherein m is an integer of 2–7.

12. A member according to claim 1 or 9, wherein the disazo pigment of the formula (2) is represented by the following formula:

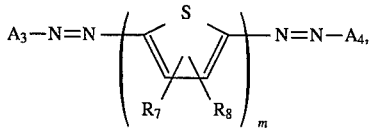

wherein m, $A_3$, $A_4$, $R_7$ and $R_8$ have the same meanings as in the formula (2) described above.

13. A member according to claim 11, wherein the disazo pigment of the formula (2) is represented by the following formula:

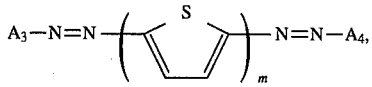

wherein m, $A_3$ and $A_4$ have the same meanings as in the formula (2) described above.

14. A member according to claim 1 or 9, wherein both of $A_3$ and $A_4$ are a coupler residue represented by the formula (3).

15. A member according to claim 1 or 9, wherein $X_1$ in the formula (3) is a residual group for forming benzocarbazole ring by condensation reaction with benzene ring.

16. A member according to claim 9, wherein the photosensitive layer comprises a charge generation layer comprising the disazo pigment as a charge-generating material and comprises a charge transport layer, and the charge transport layer is disposed on the charge generation layer.

17. A member according to claim 13, wherein m is an integer of 2–7.

18. A process cartridge, comprising: an electrophotographic photosensitive member according to claim 1 and at least one means selected from a charging means, a developing means, and a cleaning means;

wherein said photosensitive member, and said at least one means selected from the charging means, the developing means, and the cleaning means are integrally supported to form a single unit, which can be connected to or released from an apparatus body as desired.

19. A cartridge according to claim 18, wherein the photosensitive layer comprises the disazo pigment of the formula (1).

20. A cartridge according to claim 18, wherein the photosensitive layer comprises the disazo pigment of the formula (2).

21. An electrophotographic apparatus, comprising:

an electrophotographic photosensitive member according to claim 1, a charging means, an image-exposure means, a developing means and a transfer means.

22. An apparatus according to claim 21, wherein the photosensitive layer comprises the disazo pigment of the formula (1).

23. An apparatus according to claim 21, wherein the photosensitive layer comprises the disazo pigment of the formula (2).

* * * * *

UNITED STATES PATENT AND TRADEMARK OFFICE

CERTIFICATE OF CORRECTION

PATENT NO. : 5,543,257

DATED : August 6, 1996

INVENTOR(S) : KOICHI SUZUKI ET AL.

It is certified that error appears in the above-identified patent and that said Letters Patent is hereby corrected as shown below:

COLUMN 4

Line 29, "and;" should read --and--.

COLUMN 44

Line 28, "poyester," should read --polyester,--

COLUMN 53

Line 6, "was" should read --were--.
Line 20, "was" should read --were--.

COLUMN 55

Line 25, "atom." should read --atoms.--.

COLUMN 56

Line 66, "and;" should read --and--.

UNITED STATES PATENT AND TRADEMARK OFFICE

CERTIFICATE OF CORRECTION

PATENT NO. : 5,543,257

DATED : August 6, 1996

INVENTOR(S) : KOICHI SUZUKI ET AL. Page 2 of 2

It is certified that error appears in the above-identified patent and that said Letters Patent is hereby corrected as shown below:

COLUMN 57

Form (9), "$CONH-NH=C<^{R_{17}}_{R_{18}}$, should read

--$CONH-N=C<^{R_{17}}_{R_{18}}$, --.

Line 55, "atom." should read --atoms.--.

Signed and Sealed this

Twenty-fourth Day of December, 1996

Bruce Lehman

*Attest:*

BRUCE LEHMAN

*Attesting Officer*

*Commissioner of Patents and Trademarks*